US006664490B2

(12) United States Patent
Kato

(10) Patent No.: US 6,664,490 B2
(45) Date of Patent: Dec. 16, 2003

(54) SWITCHING MECHANISM AND ELECTRIC SWITCH USING THE SAME

(75) Inventor: Yuichi Kato, Tokyo (JP)

(73) Assignee: Satori-S-Tech Co., Ltd., Tokyo (JP)

( * ) Notice: Subject to any disclaimer, the term of this patent is extended or adjusted under 35 U.S.C. 154(b) by 0 days.

(21) Appl. No.: 10/298,676

(22) Filed: Nov. 19, 2002

(65) Prior Publication Data

US 2003/0098226 A1 May 29, 2003

(30) Foreign Application Priority Data

Nov. 27, 2001 (JP) ..... 2001-361372

(51) Int. Cl.[7] ..... H01H 5/00
(52) U.S. Cl. ..... 200/449; 200/332.2
(58) Field of Search ..... 200/449, 522, 200/332.2, 61.85, 501, 561, 553

(56) References Cited

U.S. PATENT DOCUMENTS 3,711,666 A * 1/1973 Sahrbacker ..... 200/522
3,745,286 A * 7/1973 Sahrbacker ..... 200/522
3,755,640 A * 8/1973 Kaman et al. ..... 200/522
3,777,092 A * 12/1973 Yeske ..... 200/337
4,149,053 A * 4/1979 Long ..... 200/522
5,075,604 A * 12/1991 Crook et al. ..... 318/17
5,380,971 A * 1/1995 Bittel et al. ..... 200/536
6,469,268 B1 * 10/2002 Schaeffeler et al. ..... 200/522

FOREIGN PATENT DOCUMENTS

DE 199 30 558 1/2000

* cited by examiner

*Primary Examiner*—Elvin Enad
*Assistant Examiner*—M. Fishman
(74) *Attorney, Agent, or Firm*—Wenderoth, Lind & Ponack, L.L.P.

(57) ABSTRACT

An AC/DC switch for electric power tools avoids bouncing when turned on, but assures quick cutting-off of heavy current. Operation does not vary with age, as might be caused by wearing of projections of the switching mechanism and/or inconsistency in spring material. A reversal spring quickly switches the mechanism on and off so that the movable contacts are brought close to the stationary contacts before the turning-on, thereby permitting the turning-on subsequent to traverse of the reversal point without bouncing of the movable contacts from the stationary contacts, and preventing movement of the movable contacts before reversal spring has stored increased energy, thus allowing quick release of stored energy to make the movable contacts leave the stationary contacts at a speed sufficient to prevent electric arcs between the movable and stationary contacts, and hence prevent the wearing of the contacts.

7 Claims, 22 Drawing Sheets

SWITCHING MECHANISM AND ELECTRIC SWITCH USING THE SAME

BACKGROUND OF THE INVENTION

1. Field of the Invention

The present invention relates to a switching mechanism and an electric switch, and more particularly to a switching mechanism for a spring-reversal type of electric switch appropriate for use in electric power tools.

2. Related Arts

Spring-reversal type of electric switches are used in electric power tools for closing and opening their circuits in which heavy current flows. Such spring-reversal type of electric switches give a pleasing click feeling to users at the time of turning on and off, and the quick "on" and "off" switching action is appropriate for closing and opening circuits in which heavy currents flow. Also, spring-reversal type of electric switches can be used commonly for AC and DC.

Spring-reversal type of electric switches, however are liable to allow their contacts to bounce at the time of turning on and off. Particularly at the time of turning "on" a rush current flows, thereby making it easy for arcs to appear across confronting contacts as a result of bouncing. Thus, the contacts will be badly worn or deformed and accordingly the life of the electric switches will be shortened.

A conventional contact-making mechanism comprises a spring reversal mechanism, a push spring for producing a given strength of pressure and associated movable contacts. The contact-making mechanism, however, is liable to reduce drastically its contact pressure just prior to the reversing action, which is caused by the push spring. If the electric switch should be shaken at the instant of the contact pressure being reduced, arks are liable to appear with the result that the contacts are badly worn or deformed.

With a view to solve these problems of spring-reversal type of electric switches, DE19930558A1 proposes an improved contact-making mechanism, which is described below by referring to FIGS. 18 to 25.

The improved spring-reversal type of electric switch 1 comprises a housing 2, a base 3, a cover 4, stationary contacts 5 and associated terminals 6, a slide 7 and associated movable contacts 8 (see FIG. 19), an operating lever 9 for switching operation, a first spring 10 and associated contact detents 11*a* and 11*b* (see FIG. 21), a second spring 12, a slider 13 and compression springs 28 (see FIG. 19).

As seen from FIG. 18, the housing 2 has four stationary contacts 5 and associated terminals 6 fastened to its bottom, and electric wires are connected to the terminals 6.

The slide 7 has four movable contacts 8 and two compression springs 28 on its lower surface as seen from FIG. 19. As seen from FIG. 20, the slide 7 is put in the housing 2 with the movable contacts 8 confronting the stationary contacts 5.

A carrier 16 has openings 17 on its opposite end walls (see FIG. 18). The carrier 16 contains the second spring 12, and is movable on the slide 7. Two stoppers 19*a* and 19*b* and a guide 14 are fastened to the upper surface of the slide 7. The guide 14 takes the role of guiding the projections 15*a* and 15*b* of the slider 13 for engaging with the second spring 12.

The slide 7 along with the slider 13 can move between the switching "off" position in which the movable contacts 8 are apart from the stationary contacts 5 and the switching "on" position in which the movable contacts 8 are in contact with the stationary contacts 5.

The second spring 12 is a compression spring, which can produce a counter force opposite to the direction in which the slide 7 moves on the way to the switching point, and can produce a force in the direction in which the slide 7 moves when the switching point has been traversed.

The first U-shaped spring 10 is a kind of compression spring, and the U-shaped spring 10 has two legs 20*a* and 20*b*, each having a ramp 21 projecting outward. The spring constant of the first spring 10 is so determined that the force produced at the switching point of the first spring 10 may be equal to the sum of the two compression springs 28 positioned behind the movable contacts 8.

The contact detents 11*a* and 11*b* are given in the form of ramps 22 projecting inward from the opposite longitudinal sides of the housing 2. Each ramp 22 is shaped asymmetric.

The first spring 10 works in cooperation with the detents 11*a* and 11*b* as follows: when the operating lever 9 is pushed and rotated about its pivot to drive the slide 7 for the switching-on position, the spring 10 is responsive to movement of the slide 7 for storing its resilient energy as a counter reaction until the point of critical compression (switching point) has been reached, at which point of critical compression the resistance to movement of the slide 7 is maximized. Then, the stored energy is suddenly released to jerk the slide 7 to the switching-on position.

The slider 13 is operatively connected to the operating lever 9 so that depression of the operating lever 9 may make the slider 13 withdraw, and that release of the operating lever 9 may make the slider 13 advance. The slider 13 has a third spring 24 contained in its chamber 27, and it has stoppers 18*a*, 18*b* and 25 formed on its front and rear sides respectively. The stoppers 18*a*, 18*b* are formed on the projections 15*a* and 15*b*.

The projections 15*a* and 15*b* act on the opposite ends of the second spring 12 via the guides 14 of the slide 7, as seen from FIG. 20.

There is play left between the stoppers 18*a*, 18*b* of the slider 13 and the stoppers 19*a*, 19*b* of the slide 7, so that the slider 13 when pushed forward may travel the short distance of play before engaging with the second spring 12.

The electric switch 1 turns on and off as follows: first, the electric switch 1 is put in the switching "off"-position as shown in FIG. 22, and then, the operating lever 9 is depressed so that the slider 13 may act on the left end of the second spring 12 via the projection 15*a* to stretch the spring 12. After reducing the play the stopper 18 mates with the stopper 19*a* with the result that the slide 7 is displaced rightward for the switching "on"-position.

The slow displacement continues until the switching point has been reached while overcoming the counter force of the first spring 10 with its opposite legs abutting the detents 11*a*, 11*b*. After traversing the switching point the energy stored in the first spring 10 and the second spring 12 are released instantly, thereby jerking the slide 7 rightward to the switching "on" position as shown in FIG. 23. The movable contacts 8 mate with the stationary contacts 5, and then, the compression spring 28 is compressed (see FIG. 20).

If it is desired that the electric switch 1 turn off, the operating lever 9 is released to reset the slider 13 by the third spring 24 (see FIG. 20). In resetting the slider 13 the projection 15*b* acts on the right end of the second spring 12, stretching the second spring 12 after reducing the play. For the while the slide 7 remains still, keeping the movable contacts 8 and stationary contacts 5 mating together.

Thereafter the slide 7 moves a very short distance leftward by the force of the first spring 10 abutting the steep inclinations 29*b* of the ramps 22. The movable contacts 8, however, are kept still abutting on the stationary contacts 5 as the compression spring 28 is loosened. This position continues until the switching point has been reached (see FIG. 25).

After the switching point is traversed, the total energy stored in the first spring 10 and the second spring 12 is released to jerk the slide 7 leftward instantly, allowing the movable contacts 8 to leave the stationary contacts 5. Thus, the electric switch 1 turns "off", as shown in FIG. 22.

The electric switch 1 uses the compression spring (first spring 10) to suppress the bouncing of the movable contacts off the stationary contacts. Specifically the movable contacts are so controlled that they may come to touch the stationary contacts slowly, and that they may leave the stationary contacts quickly. It is, therefore, most likely that the switching "on" and "off" timing varies significantly with the quality of the spring 10 used and with the wearing of the ramps 22 of the detents 11*a* and 11*b*. Therefore, electric switches having the same switching characteristics can hardly be reproduced.

One object of the present invention is to provide a heavy-current, long-lived AC/DC switching mechanism which is free of bouncing at the time of turning on, and is capable of cutting off the flow of heavy electric current instantly at the time of turning off.

SUMMARY OF THE INVENTION

A switching mechanism in a spring-reversal type of electric switch comprising: a casing having stationary contacts mounted therein; an actuator having movable contacts to mate with the stationary contacts and springs to push the rear sides of the movable contacts; an operating lever rotatable about its pivot for switching operation; a plunger operatively connected to the operating lever; a rotatable reversal member for driving the actuator; a reversal coiled spring one end of which is connected to the reversal member and the other end of which is connected to the plunger, the reversal coiled spring being responsive to transition across its reversal point for reversing its resilient force in direction, thus making the movable contacts move toward the stationary contacts or leave apart therefrom when depressing or releasing the operating lever, wherein the switching mechanism is so constructed that the actuator is allowed to move a predetermined distance before reaching the reversal point on the way to the switching "on" position, thus reducing the distance to the switching "on" position to travel the remaining distance instantly when the reversal member reverses, thereby making the movable contacts mate with the stationary contacts quickly. The distance to the switching "on" position is reduced to be short enough to cause little or no bouncing even if the movable contacts travel the remaining distance quickly to abut on the stationary contacts.

Also, the switching mechanism is so constructed that the actuator is prevented from moving before the reversal point is reached, and that the actuator is released after the reversal point is reached, thereby making the movable contacts leave the stationary contacts quickly. The reversal coiled spring can store a repulsive energy of the quantity large enough to make the movable contacts leave the stationary contacts very quickly when the stored energy is released. Also, advantageously the compressed coiled spring prior to arrival at the reversal point applies a push of good strength to the movable contacts against the stationary contacts, thereby avoiding unstable mechanical and electric contact between the movable and stationary contacts, which would be caused if the contact pressure were decreased between the movable and stationary contacts.

The rotatable reversal member has a pinion equipped therewith whereas the actuator has a rack equipped therewith. With this arrangement rotation of the reversal member is converted to the horizontal linear movement.

The plunger has a projection formed thereon; the rotatable reversal member has a projection formed thereon. These projections are so arranged that the projection of the plunger is responsive to depression of the operating lever for pushing the projection of the rotatable reversal member, thereby making the reversal member rotate thus to move the actuator and hence, the movable contacts close to the stationary contacts while stressing the reversal coiled spring.

The forward end of the plunger has a difference in level via a gentle slope formed on its lower surface. A stopper having a hook formed thereon is biased upward by a stopper spring to keep the stopper abutting on the lower surface of the plunger. The actuator has a projection to be caught by the hook of the stopper. With this arrangement the actuator is locked by allowing the projection of the actuator to be caught by the hook of the stopper. While the stopper follows and climbs the lower surface of the forward end of the plunger the actuator is being unlocked by releasing the projection of the actuator from the hook of the stopper.

On the way to the switching "on" position the stopper is raised, and the projection of the actuator climbs the hook of the raised stopper to be caught thereby, when the movable contacts abut on the stationary contacts, together put in locking condition.

The operating lever is released toward the switching "off" position to move the plunger, the gentle slope of the forward end of which still holds the hook of the stopper and the projection of the actuator in the locking condition for a while after the reversal point of the reversal spring is traversed. Upon further movement of the operating lever toward the switching "off" position the stopper follows the gentle slope of the forward end of the plunger to be lowered for unlocking and jerking the actuator, thus making the movable contacts leave the stationary contacts quickly.

An electric switch according to the present invention comprises: an operating lever rotatable about its pivot; a plunger operatively connected to the operating lever to move linearly in response to rotation of the operating lever; a reversal member operatively connected to the plunger; a pinion fixed to the lower surface of the reversal member; a spring combined with the reversal member, responsive to the linear movement of the plunger for storing its resilient force until a predetermined strength of resilient force has been reached, and for releasing the stored strength of resilient force to rotate the pinion of the reversal member; an actuator having movable contacts and having a rack to meet with the pinion for moving linearly in unison with rotation of the pinion; and a casing having stationary contacts on its opposite sides, whereby the movable contacts and stationary contacts are made to meet with each other in unison with reversal action of the reversal spring.

The rotational-and-linear mechanism stores a predetermined strength of driving force, reducing the frictional engagement of associated parts. This has the effect of avoiding the wearing of parts caused by friction, and hence extending the life of the electric switch.

Other objects and advantages of the present invention will be understood from the following description of a spring-reversal type of electric switch according to one preferred embodiment of the present invention, which is shown in the accompanying drawings.

DETAILED DESCRIPTION OF PREFERRED EMBODIMENT

Figure 1:
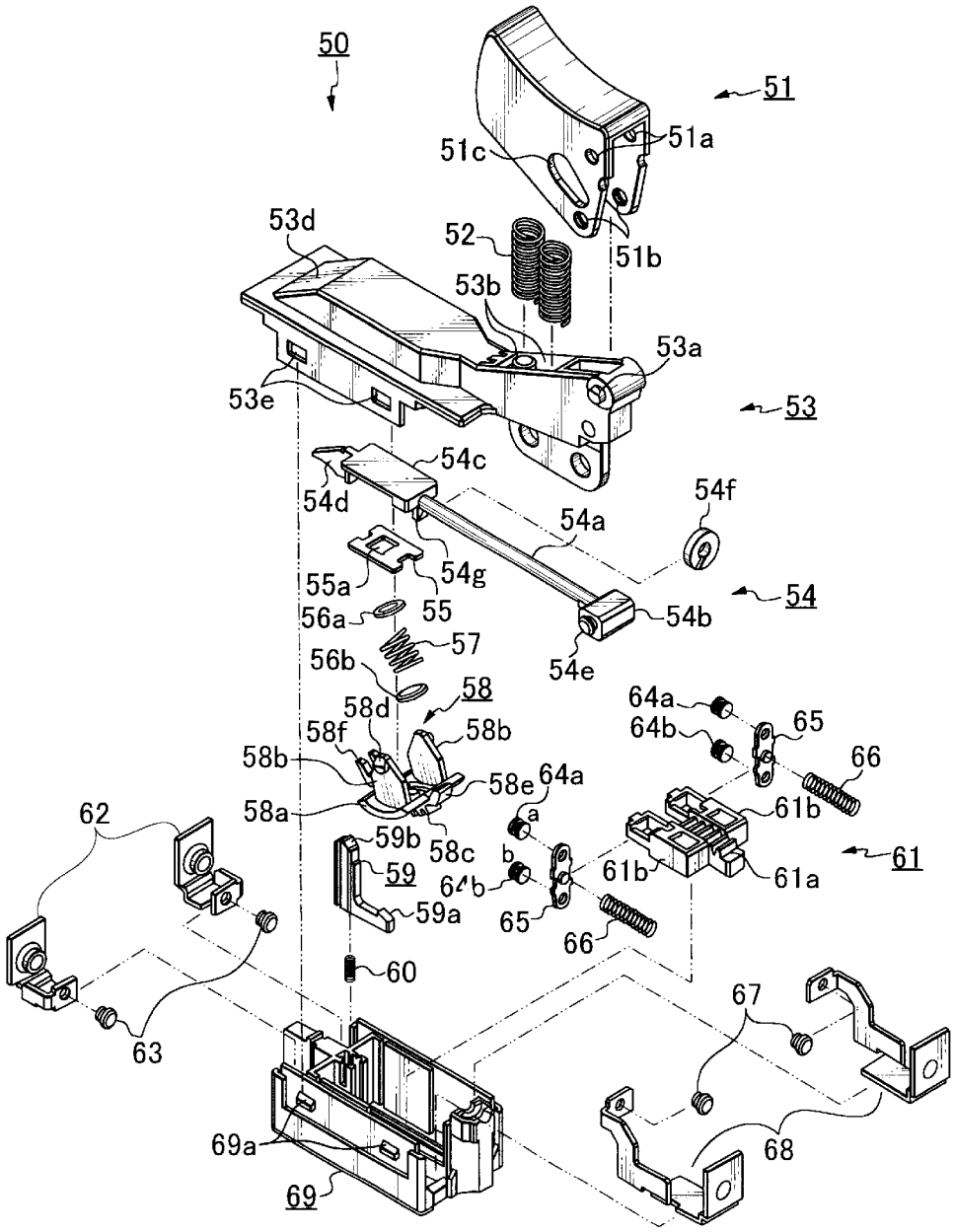
FIG. 1 is an exploded view of an electric switch according to one embodiment of the present invention.
Figure 2:
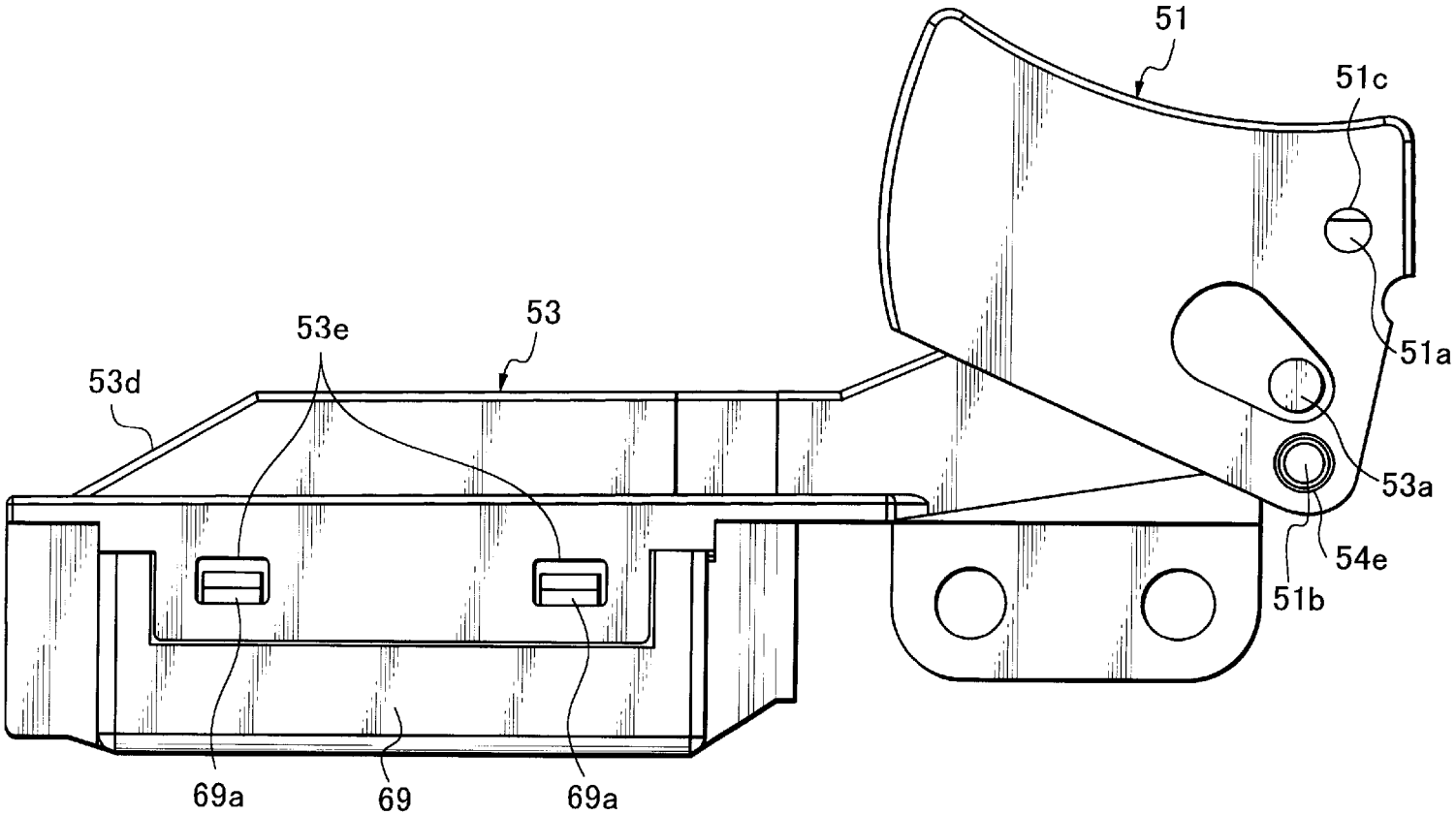
FIG. 2 is a side view of the electric switch.
Figure 3:
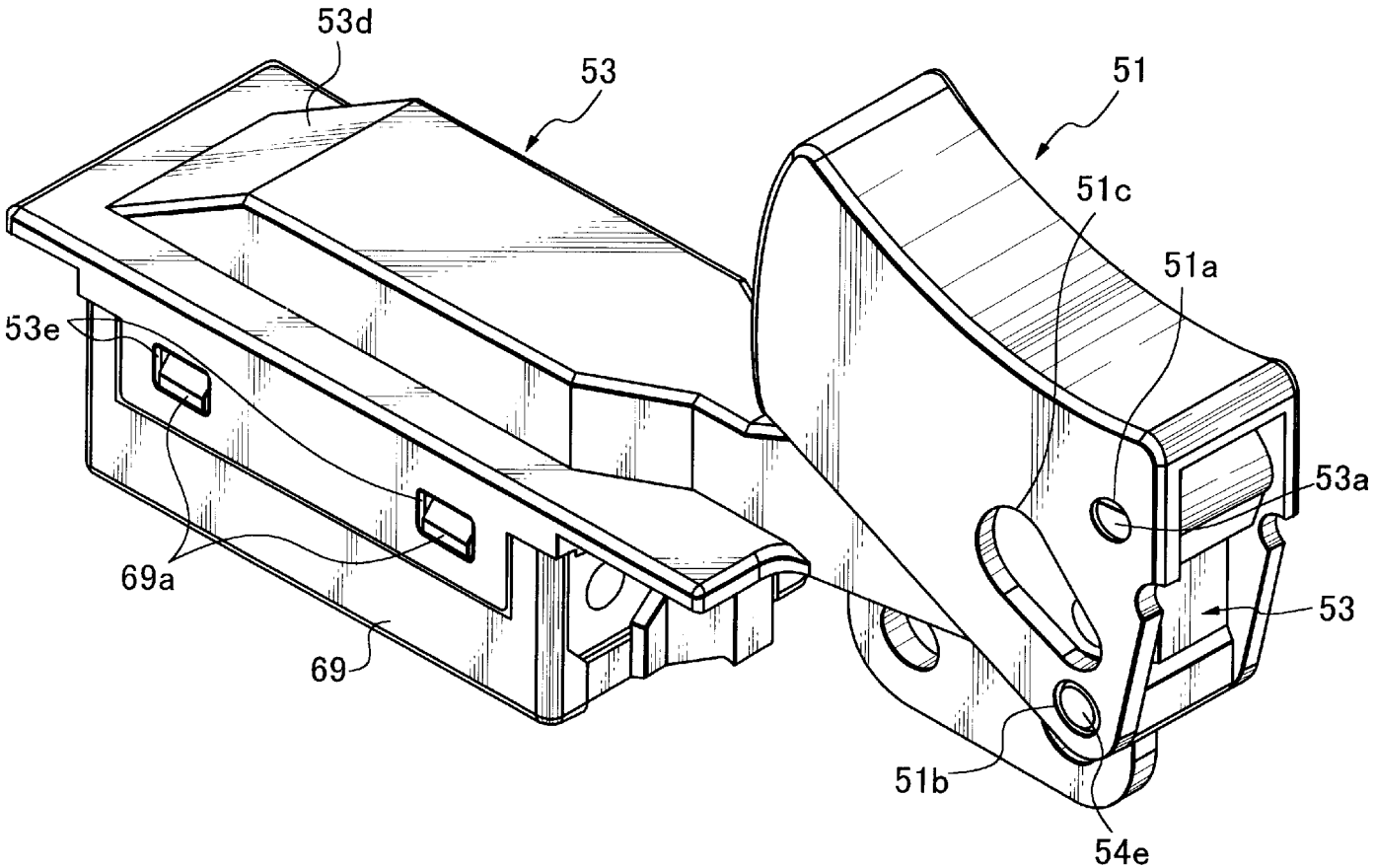
FIG. 3 is a perspective view of the electric switch.

A switching mechanism and an electric switch using the same according to one embodiment of the present invention are described below. In the drawings the left sides of the drawings corresponds to the front side of the electric switch and the right sides of the drawings corresponds to the rear side of the electric switch. The electric switch is equipped with the switching mechanism, and therefore, the electric switch is described by describing the switching mechanism only.

As seen from FIG. 1, a spring-reversal type of electric switch 50 equipped with a switching mechanism according to the present invention comprises an operating lever 51, two return springs 52, a cover 53, a plunger 54, a guide plate 55, upper and lower disks 56*a* and 56*b*, a reversal spring 57, a reversal member 58, an L-shaped stopper 59, a stopper spring 60, an actuator 61, two terminals 62, two stationary contacts 63, four movable contacts 64*a*, 64*b*, two movable pieces 65, two compression springs 66, two stationary contacts 67, two terminals 68 and a casing 69.

These parts are assembled as indicated by dot-and-dash lines in FIG. 1 into a spring-reversal type of electric switch 50 as shown in FIGS. 2 to 6. Referring to these drawings, it is described how these parts are constructed and related operatively with each other, and how these parts work in unison.

The operating lever 51 is spring-biased upward. Depression of the operating lever 51 makes the switching mechanism turn on, and release of the operating lever 51 makes the switching mechanism turn off.

Specifically the operating lever 51 comprises an upper section curved to be in conformity with the finger, two side sections integrally connected to the upper section and a front section integrally connected to the upper and side sections, opening on its rear and lower sides. The hollow case-like operating lever 51 has two holes 51*a* made on its opposite side sections whereas the cover 53 has two pivots 53*a* projecting from the opposite sides of the rearmost part of the cover 53. The operating lever 51 can be connected to the cover 53 by fitting the pivots 53*a* in the holes 51*a* of the operating lever 51.

Also, the operating lever 51 has another two holes 51*b* made on its opposite side sections. The pivots 54*e* of the plunger 54 are fitted in the holes 51*b* of the operating lever 51 as later described. In addition, the operating lever 51 has two cocoon-like holes 51*c* made on its opposite side sections. The operating lever 51 has two projections 51*d* projecting from the ceiling of the operating lever, thereby holding the upper ends of the return springs 52 (see FIG. 4). The cover 53 has two projections 53*b* standing upright from its floor, thereby holding the lower ends of the return springs 52 (see FIG. 4). The return springs 52 bias the cover 53 upward all the time.

Figure 4:
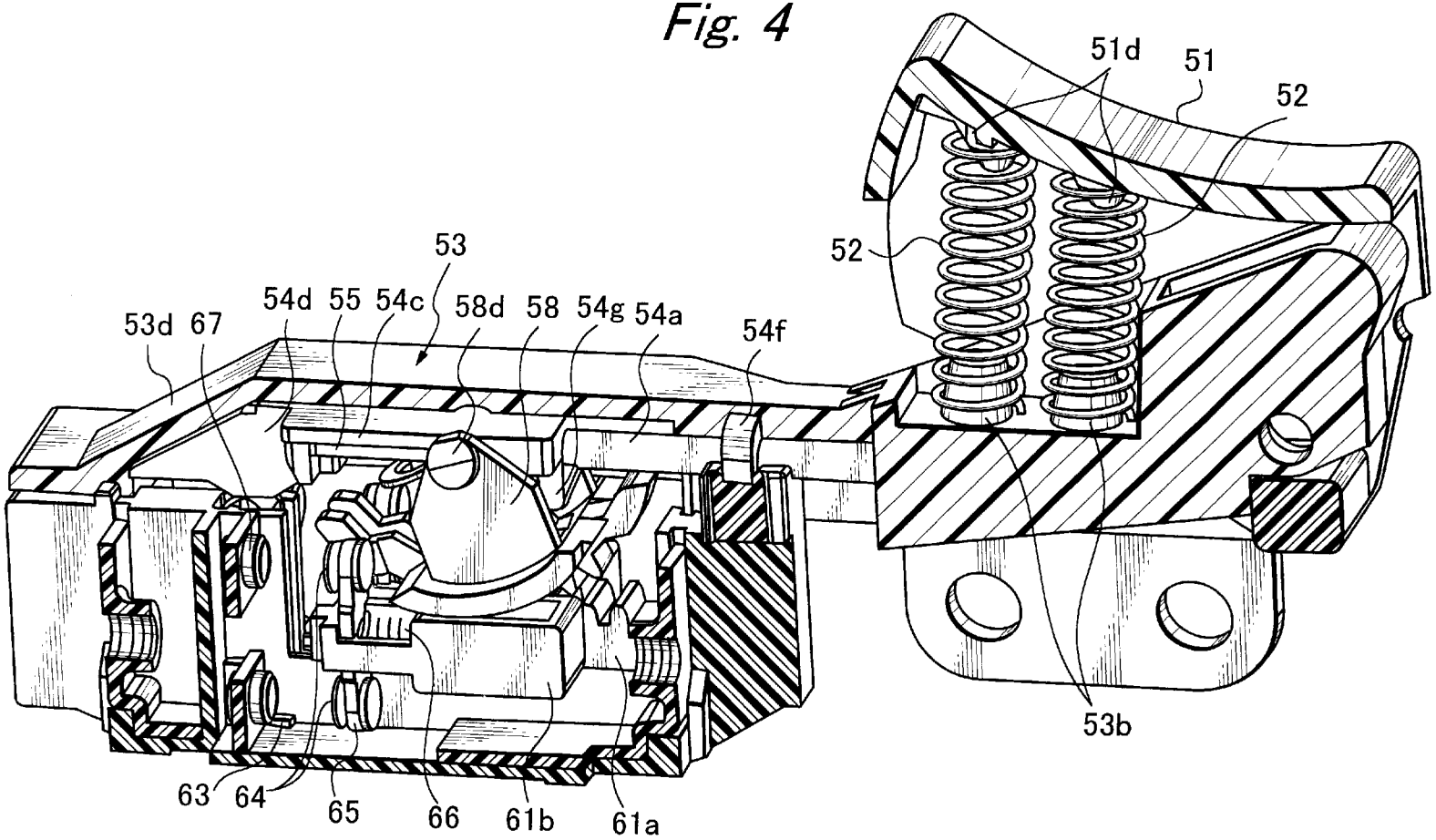
FIG. 4 illustrates, partly in section, the electric switch.
Figure 5:
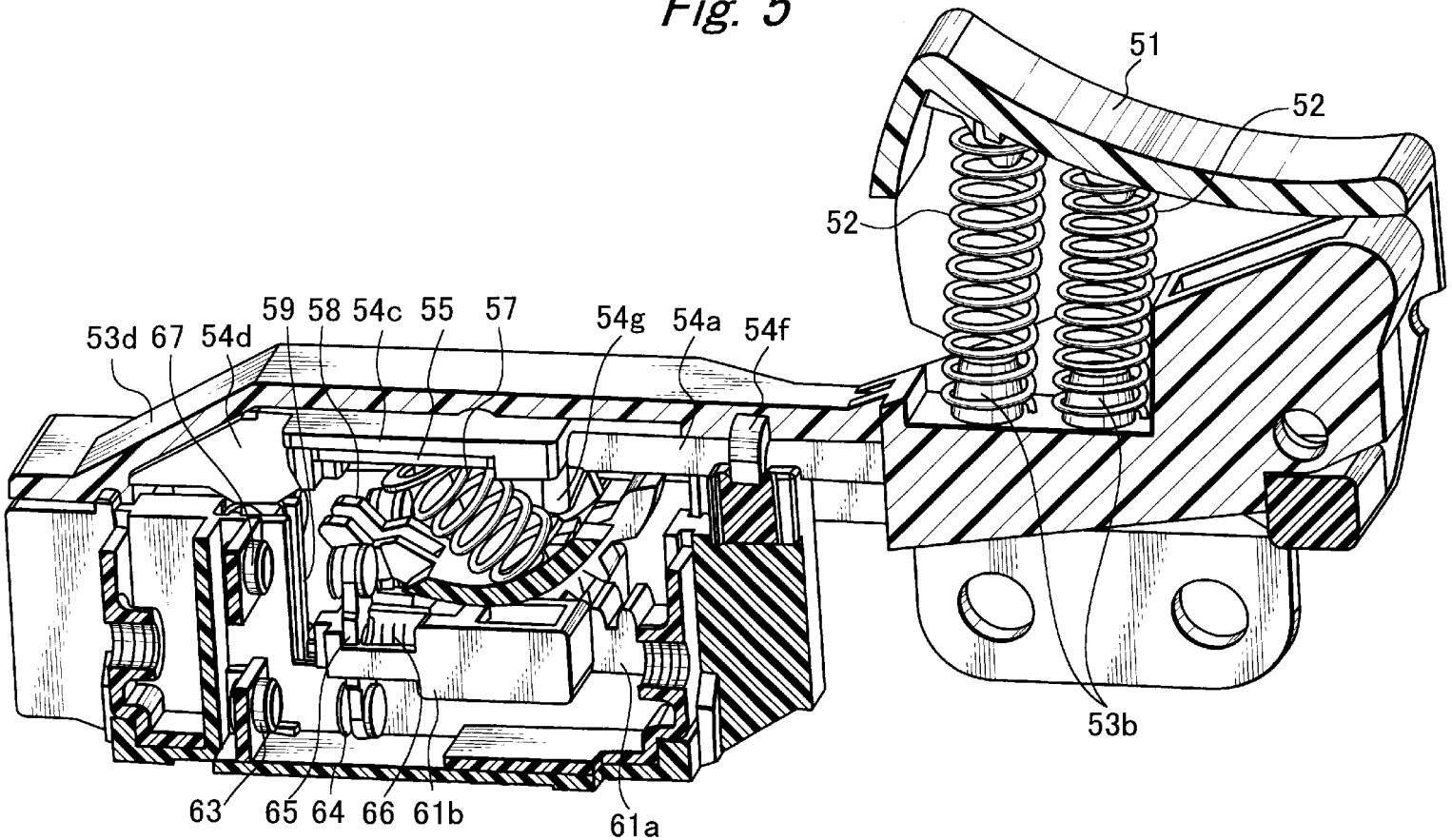
FIG. 5 is a similar view as FIG. 4, removing the sidewall of a reversal member.

Referring to FIGS. 2 to 6, the cover 53 has different functions in its front and rear portions. As shown in FIGS. 4 and 5, the rear portion supports the return springs 52, and is connected to the rear part of the operating lever 51.

The front portion of the cover 53 covers the casing 69, enclosing the plunger 54. The oblique front 53*d* of the cover 53 defines a space allotted to the inclined front 54*d* of the plunger 54, permitting the inclined front 54*d* of the plunger 54 to move back and forth in the space.

The opposite side sections of the cover 53 cover the opposite sides of the casing 69 with the nails 69*a* of the casing 69 snapped in the holes 53*e* of the cover 53.

As seen from FIG. 1, the plunger 54 comprises a stem 54*a*, a rear block 54*b* integrally connected to the rear end of the stem 54*a*, a rectangular, flattened and inverted "U"-shaped block 54*c*, a triangular-pointed front 54*d* integrally connected to the flattened and inverted "U"-shaped block 54*c* and a guide plate 55 fastened to the lower surface of the flattened and inverted "U"-shaped block 54*c*. A first projection 54*g* projects downward from the rear end of the flattened and inverted "U"-shaped block 54*c*, and a projection 55*a* projects downward from the center of the guide plate 55 (see FIG. 6).

The rear block 54*b* has pivots 54*e* extending outward from its opposite sides, which are fitted in the pivot holes 51*b* made in the operating lever 51. Inclination of the operating lever about the pivots 54*e* is transmitted to the rear block 54*b*. Reciprocation of the rear block 54*b* is transmitted to the flattened and inverted "U"-shaped block 54*c* via the stem 54*a*.

The triangular front 54*d* extends from the middle of the flattened and inverted "U"-shaped block 54*c*. The upper contour of the triangular front 54*d* is in conformity with the inside of the oblique front of the cover 53. The lower surface of the triangular front 54*d* is defined by a first horizontal surface 54*d*1, a first downward-oblique surface 54*d*3 continuous from the rear end of the first horizontal surface, a second horizontal surface 54*d*2 continuous from the rear end of the downward-oblique surface and a second upward oblique surface 54*d*4 continuous from the rear end of the second horizontal surface, reaching the flattened and inverted block 54*c*(see FIG. 6).

As described later, the L-shaped stopper 59 is kept in contact at its top end with the contour of the lower surface of the triangular front 54*d* to control the vertical movement of the L-shaped stopper and the on-and-off timing.

The first projection 54*g* of the plunger 54 has the role of moving the projection 58*e* of the reversal member 58, as described later. The projection 55*a* of the guide plate 55 abuts on the upper disk 56*a*, engaging with the upper end of the reversal coiled spring 57.

A packing 54*f* has a center aperture to allow the stem 54*a* to pass therethrough, so that it is fitted in between the cover 53 and the casing 69, thereby preventing invasion of dust when the plunger 54 moves back and forth.

The guide plate 55 is press-fitted in between the opposite legs of the flattened and inverted "U"-shaped block 54*c* of the plunger 54, and the intermediate projection 55*a* engages with the upper disk 56*a*, as described above.

Figure 6:
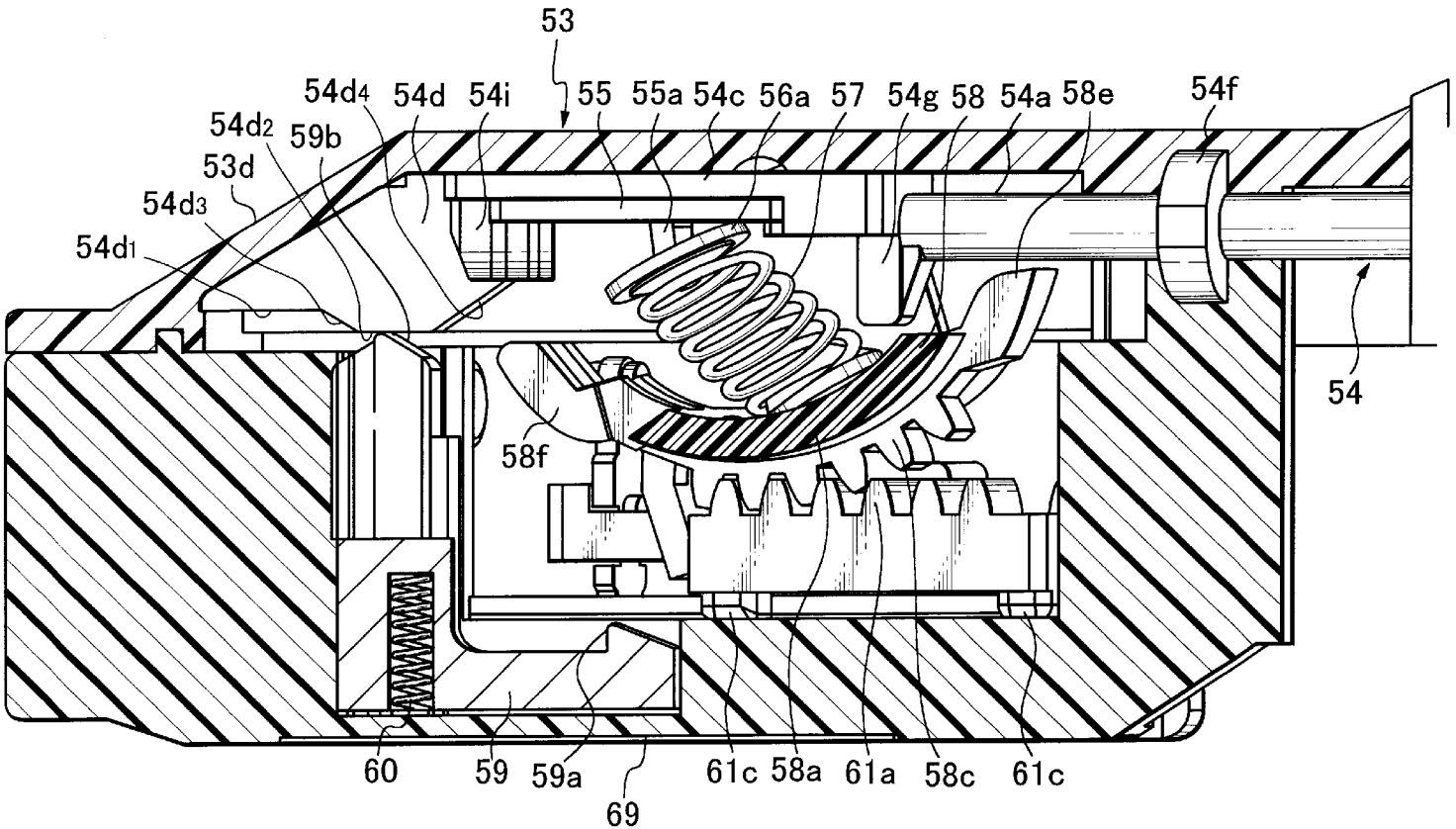
FIG. 6 illustrates, partly in section, a switching mechanism.

The upper disk 56*a* has a concavo-convex surface larger than the diameter of the projection 55*a* of the guide plate 55 (see FIG. 6). The projection 55*a* of the guide plate 55 abuts on the concave surface of the upper disk 56*a*, thereby permitting the upper disk 56*a* to incline like a spindle. Thus, reciprocation of the plunger 54 can be transmitted from the projection 55*a* to the reversal spring 57 via the upper disc 56*a*.

The lower disk 56*b* has a concavo-convex surface larger than the diameter of the projection of the reversal member 58. The round end of the projection of the reversal member 58 abuts on the concave surface of the lower disk 56*b*, thereby permitting the lower disk 56*b* to incline like a spindle.

The reversal spring 57 is sandwiched between the upper and lower disks 56*a* and 56*b* under a predetermined pressure, and it is responsive to the reciprocation of the plunger 54 for inclining forward and rearward, storing its resilient force. When the reversal spring 57 reaches the reversal point, the stored energy is increased to the maximum.

The reversal member 58 comprises a rectangular, upward-curved circular-arc plate 58*a* whose width is somewhat narrower than the inner width of the cover 53, two side plates 58*b* standing upright from the circular-arc plate 58*a*, separated from each other a distance somewhat longer than the diameter of the lower disc 56*b*, an elongated pinion 58*c* extending along the outer surface of the circular-arc plate 58*a*, patches 58*d* fastened to the upper ends of the side plates 58*b*, a rear projection 58*e* integrally connected to the rear end of the pinion 58*c* and a front projection 58*f* integrally connected to the front end of the pinion 58*c*.

The reversal spring 57 is put in between the opposite side plates 58*b*. The pinion 58*c* engages with -the rack 61*a* of the actuator 61 for converting inclination of the operating lever 58 to the linear movement of the actuator 61, as later described. The patches 58*d* are fitted in the holes made in the upper, inner sides of the cover 53 to provide pivots about which the reversal member 58 can rotate (see FIG. 4). The rear projection 58*e* is operatively related with the first projection 54*g* of the plunger 54 as later described. The front projection 58*f* is operatively related with the projection 54*i* of the plunger 54.

The reversal member 58 is pressed by the reversal spring 57 all the time. The pressure is increased to the maximum at the reversal point of the reversal spring 57.

The L-shaped stopper 59 has its vertical leg slidably fitted in the vertical slot, which is provided at the intermediate of the front end of the casing 69. The vertical leg 59 has a rearward-inclined surface 59*b* defined on its upper end. The L-shaped stopper 59 is kept at its upper end in contact with the lower surface of the front 54*d* of the plunger 54.

The horizontal leg of the L-shaped stopper 59 extends rearward in parallel with the floor of the casing 69. The horizontal leg of the L-shaped stopper 59 has a rearward-inclined projection formed as a hook 59*a*. The hook 59*a* is adapted to be engaged with the projection 61*c* of the actuator 61.

The stopper spring 60 is put in a hole, which is made in the vertical leg of the L-shaped stopper 59. Thus, the L-shaped stopper 59 is raised upward, so that it may follow the lower surface contour of the front 54*d* of the plunger 54 when moving back and forth.

As seen from FIG. 6, when the vertical leg of the stopper 59 is kept at its upper end in contact with the second horizontal surface 54$d_2$ of the lower contour of the front 54*d* of the plunger 54, the stopper 59 is lowered against the stopper spring 60. As the upper end 59*b* of the vertical leg of the stopper 59 is displaced rearward, it climes the first oblique slope 54$d_3$. While the upper end 59*b* of the vertical leg of the stopper 59 remains in contact with the first horizontal surface 54$d_1$ of the front 54*d*, the stopper 59 is kept at its raised level.

The lengths of the horizontal and oblique surfaces are determined in consideration of the time at which the projection 61*c* of the actuator 61 is caught by the hook 59*a* of the stopper 59, i.e., at the time of switching "off" or of the movable contacts leaving the stationary contacts.

The rack 61*a* engages with the pinion 58*c* of the reversal member 58; two box-like guide blocks 61*b* are integrally connected to the opposite sides of the rack 61*a*; two movable contact pieces 65 are fastened to the guide blocks 61*b* on their front sides, each contact piece 65 having upper and lower contacts 64*a* and 64*b* fixed to its front surface; two compression springs 66 push the movable contact pieces 65 forward, each compression spring 66 being fitted in the box-like guide block 61*b*; and two projections 61*c* project downward from the lower surface of the rack 61*a*. All of these parts together make up the actuator 61.

The so constructed actuator 61 can be moved back and forth by the reversal member 58. The actuator 61 moves on an actuator guide, which is laid on the floor of the casing 69, carrying the movable contacts 64 to attain the on-and-off switching action. Specifically forward movement of the actuator 61 makes the movable contacts 64 touch the stationary contacts 63 and 67 whereas rearward movement of the actuator 61 makes the movable contacts 64 leave the stationary contacts 63 and 67.

The two terminal pieces 62 are fixed to the front, opposite portions of the floor of the hollow casing 69, and the stationary contacts 63 are fixed to the terminals 62. These lower stationary contacts 63 confront the lower movable contacts 64*b* of the actuator 61.

On the other hand, two Z-shaped terminal pieces 68 are fixed at their feet to the rear, opposite portions of the floor of the casing 69, and two stationary contacts 67 are fixed to the bent ends of the raised arms of the Z-shaped terminal pieces 68, confronting the upper movable contacts 64*a* of the actuator 61.

The casing 69 is like a box having front, rear and opposite sidewalls to define its inner space. Each sidewall is composed of two upright plates, between which the arm of each terminal piece 68 is inserted.

The plunger 54, the reversal member 58 and the actuator 61 together provide a switching mechanism, in which these parts are so linked that the movable contacts 64 may touch the stationary contacts 63, 67 slowly, and that the movable contacts 64 may leave the stationary contacts 63, 67 quickly.

Referring to FIGS. 7*a* to 17*b*, the manner in which the switching mechanism works is described below. Each pair of drawings (i.e. FIGS. 7*a* and 7*b*, FIGS. 8*a* and 8*b*, FIGS. 9*a* and 9*b*, etc.) presents two sectional views illustrating how the movable contacts are displaced with respect to the stationary contacts; and how the reversal member 58 is related with the actuator 61 in operation.

Figure 7A:
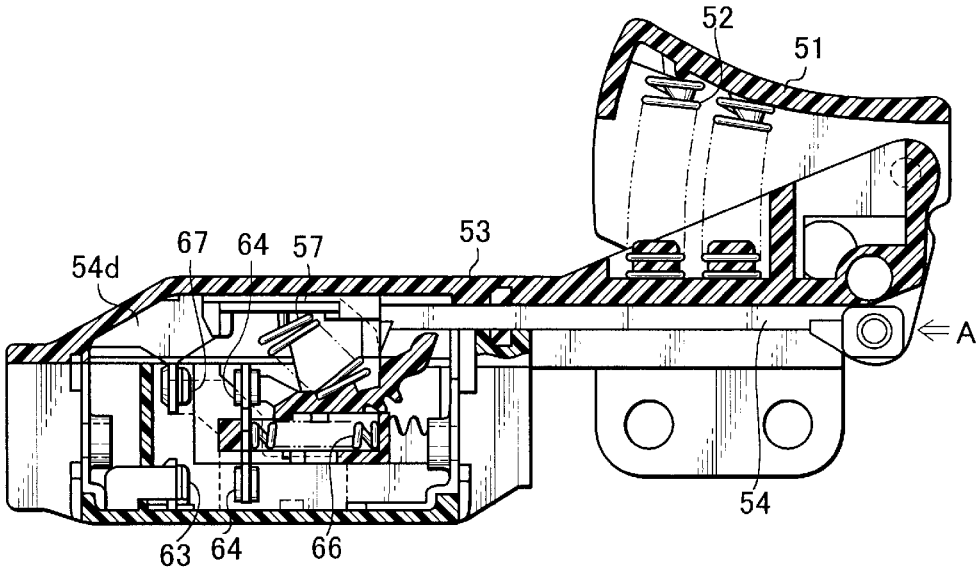
FIGS. 7*a* and 7*b* are longitudinal sections of the electric switch, showing how the electric switch works.
Figure 7B:
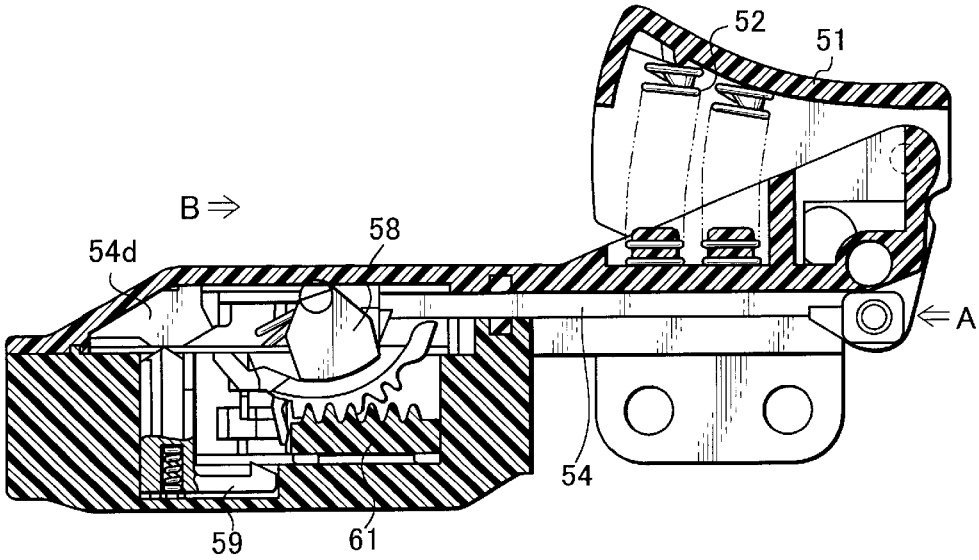

Referring to FIGS. 7*a* and 7*b*, in the initial position in which the electric switch is not operated, the plunger 54 is energized by the return spring 52 in the direction as indicated by the arrow "A". The front 54*d* of the plunger 54 abuts against the inner wall of the front of the cover 53, thus preventing further advance of the plunger 54. In this position the reversal member 58 is urged counterclockwise by the reversal spring 57, and therefore, the actuator 61 is energized in the direction as indicated by the arrow "B", but it cannot move.

Figure 8A:
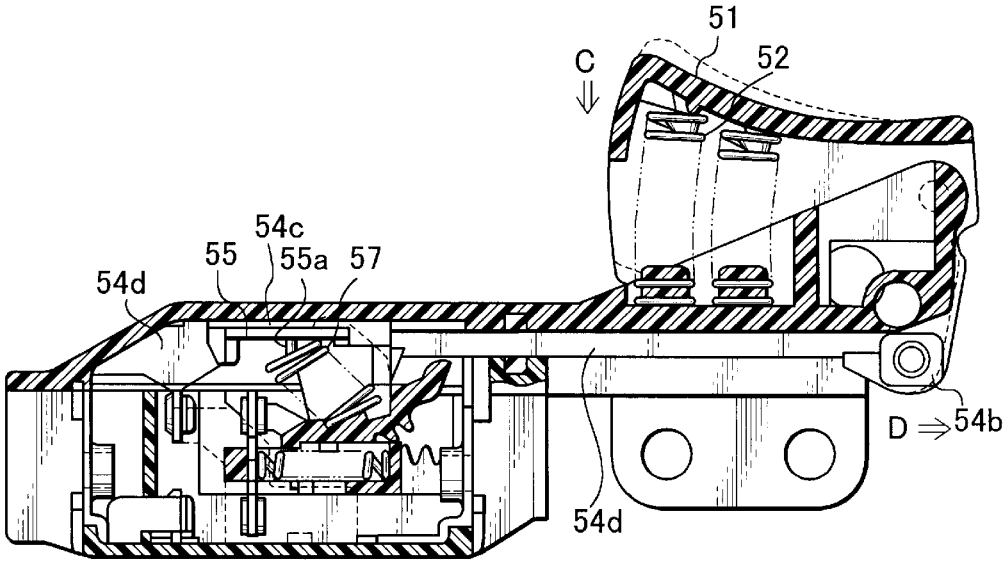
FIGS. 8*a* and 8*b* are longitudinal sections of the electric switch, showing how the electric switch works.
Figure 8B:
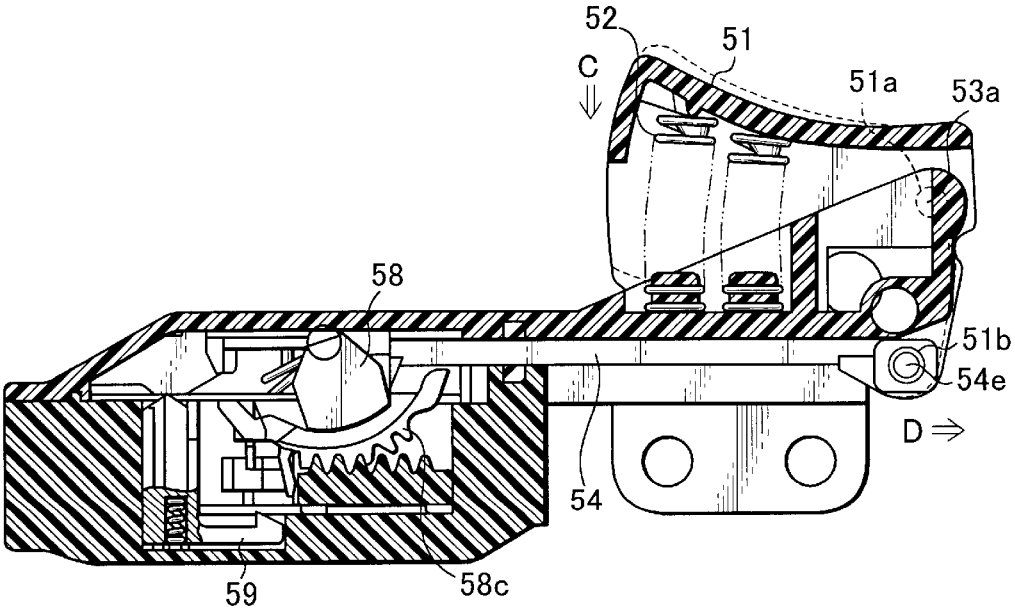

Referring to FIGS. 8*a* and 8*b*, the operating lever 51 is pushed to rotate in the direction as indicated by the arrow "C", pulling the rear block 54*b* in the direction as indicated by the arrow "D". Accordingly the flattened and inverted "U"-shaped block 54*c* and the projection 55*a* of the underlying guide plate 55 are pulled in the direction as indicated by the arrow "D". Then, the projection 55*a* pushes the upper disk 56*a* rearward, beginning compression of the reversal spring 57, but the reversal member 58 still holds the associated parts as they are.

Figure 9A:
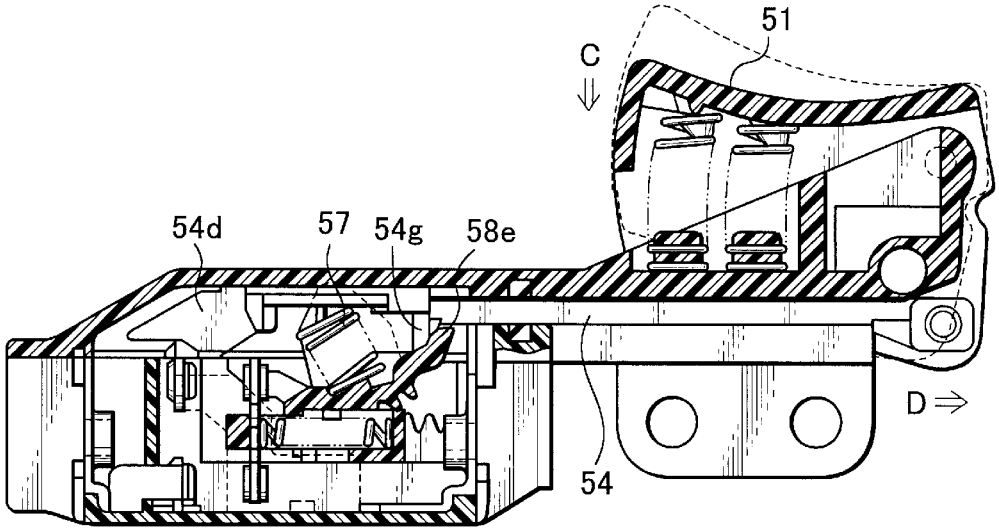
FIGS. 9*a* and 9*b* are longitudinal sections of the electric switch, showing how the electric switch works.
Figure 9B:
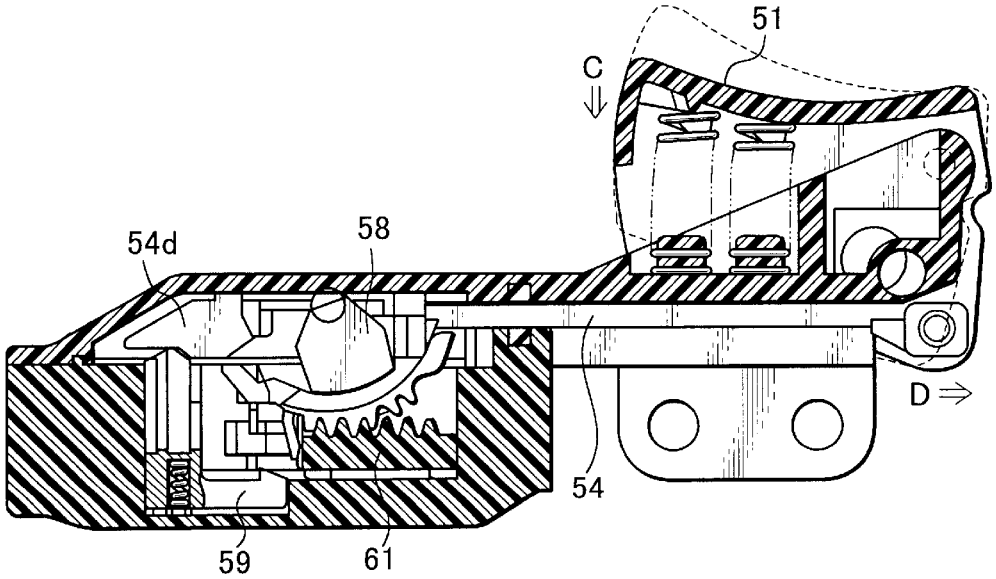

Referring to FIGS. 9*a* and 9*b*, the operating lever 51 is rotated further in the direction as indicated by the arrow "C", and the plunger 54 is moved in the direction as indicated by the arrow "D", allowing the stopper 59 to follow the lower surface contour of the front 54*d* of the plunger 54. Further movement of the plunger 54 in the direction "D" makes the projection 54*g* of the plunger 54 abut on the projection 58*e* of the reversal member 58. The reversal member 58 still holds the associated parts as they are.

Figure 10A:
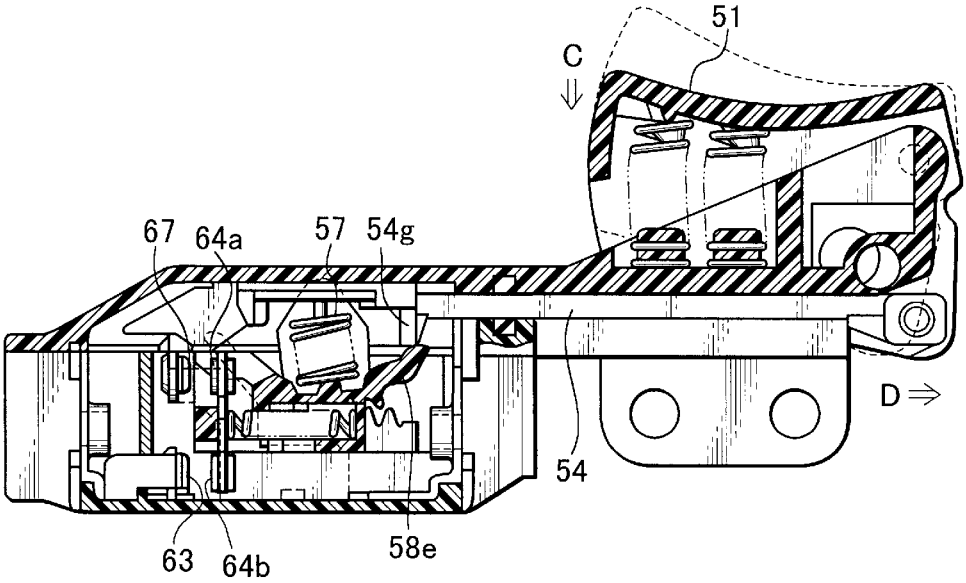
FIGS. 10*a* and 10*b* are longitudinal sections of the electric switch, showing how the electric switch works.
Figure 10B:
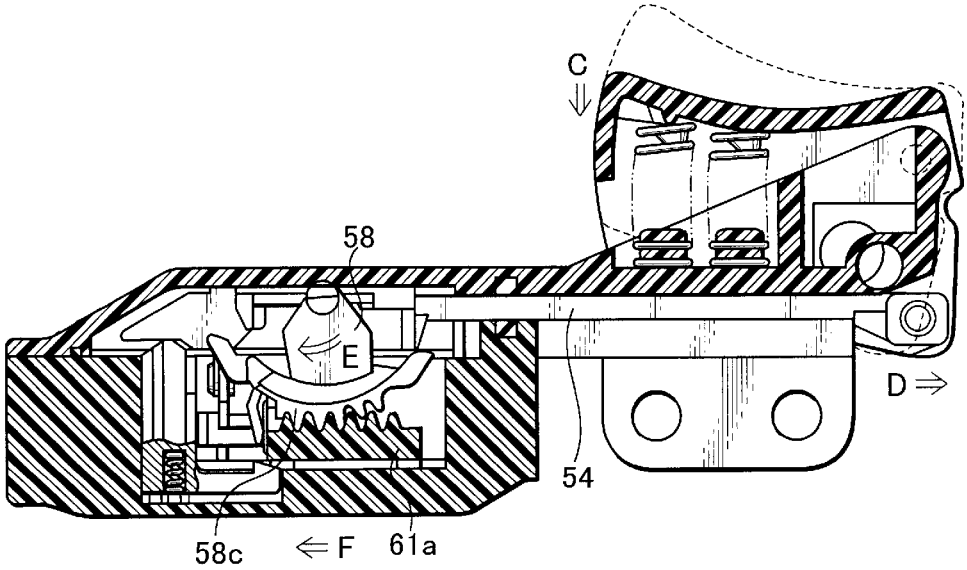
Figure 11A:
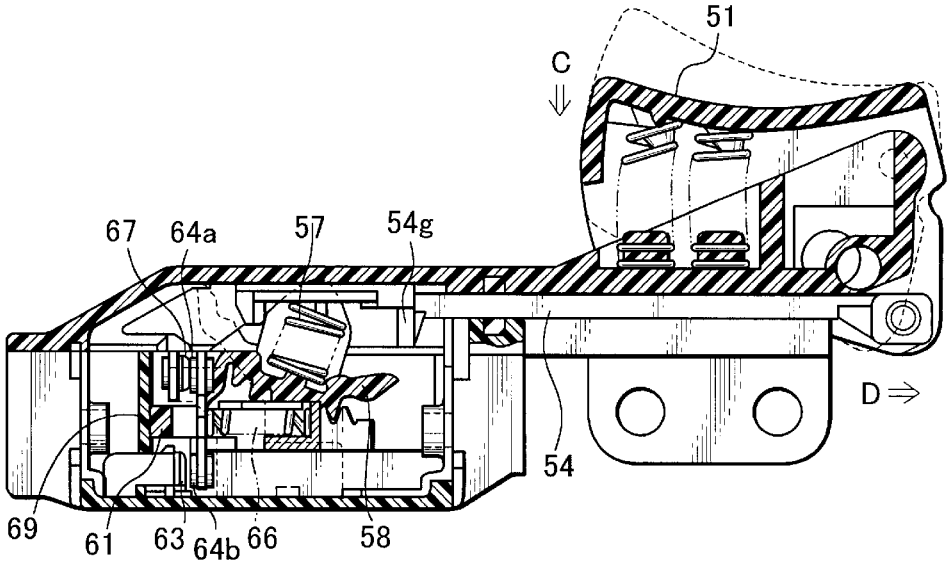
FIGS. 11*a* and 11*b* are longitudinal sections of the electric switch, showing how the electric switch works.
Figure 11B:
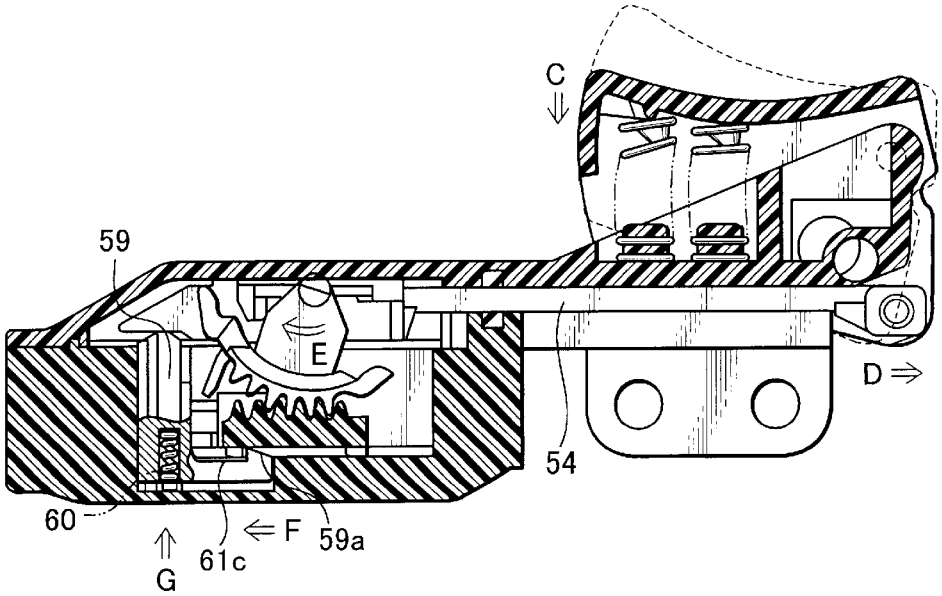

Referring to FIGS. 10*a* and 10*b*, further rotation of the operating lever 51 in the direction as indicated by the arrow "C" pulls the plunger 54 in the direction as indicated by the arrow "D", thereby making the projection 54*g* of the plunger 54 push the projection 58*e* of the reversal member 58 backward. The reversal member 58 is rotated in the direction as indicated by the arrow "E", thereby making the rack 61*a* move in the horizontal direction as indicated by the arrow "F" through the agency of the pinion 58*c* of the reversal member 58. As a result, the distance between the movable contacts 64 and the stationary contacts 63, 67 is reduced. As the reversal spring 57 has not reached the reversal point, the reversal member 58 is still prevented from turning toward the opposite side.

Further rotation of the operating lever 51 in the direction as indicated by the arrow "C" pulls the plunger 54 in the direction as indicated by the arrow "D" still further (see FIGS. 11*a* and 11*b*), thereby making the projection 55*a* of the guide plate 55 catch and pull the reversal spring 57 by the upper end in the horizontal direction as indicated by the arrow "D". Then, the reversal spring 57 reaches the reversal point for releasing the energy stored in the reversal spring 57.

At the time of traversing the reversal point the reversal spring 57 extends to apply its resilient force to the reversal member 58, thereby forcedly rotating the reversal member 58 in the direction as indicated by the arrow "E". Accordingly the actuator 61 is jerked in the direction as indicated by the arrow "F", making the forward guide projection 61*c* ride over the oblique surface of the hook 59*a* of the stopper 59 while overcoming the counter force applied by the stopper spring 60. Then, the actuator 61 moves until the front of the actuator 61 has abutted on the wall of the casing 69, where the actuator 61 stops.

In this position the movable contacts 64 come to touch the stationary contacts 63, 67, making the electric switch turn on. The movable contacts 64 are pushed against the stationary contacts 63, 67 by the compression springs 66, which are contained in the guide blocks 61*b* of the actuator 61. The distance between the movable contacts and the stationary contacts is reduced to be short enough to prevent the movable contacts from bouncing off the stationary contacts when hitting them.

The force applied to the reversal member 58 by the reversal spring 57 is stronger than the force of the compression springs 66, and therefore, the actuator 61 cannot be moved in the direction opposite to that indicated by the arrow "F" to reduce the pressure appearing between the movable and stationary contacts 64 and 63, 67.

Figure 12A:
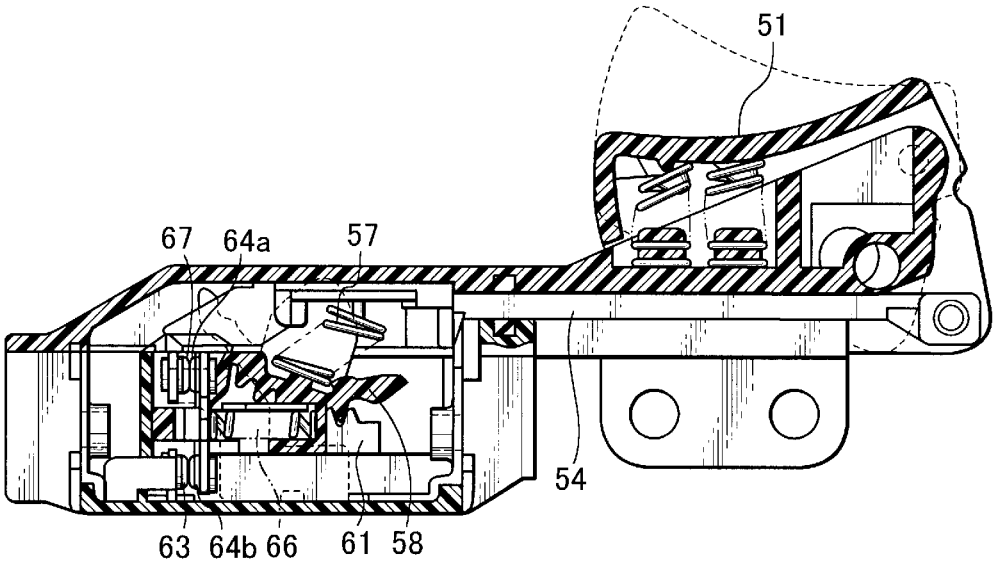
FIGS. 12*a* and 12*b* are longitudinal sections of the electric switch, showing how the electric switch works.
Figure 12B:
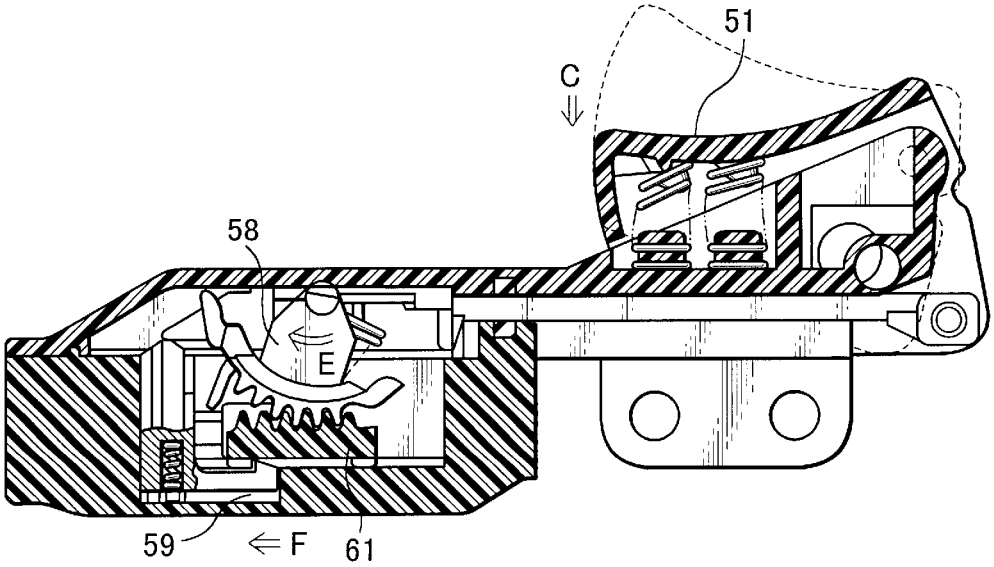

Referring to FIGS. 12*a* and 12*b*, the operating lever 51 is fully rotated, and then, the reversal member 58 is kept energized in the direction as indicated by the arrow "E", and the actuator 61 is kept energized in the direction as indicated by the arrow F. The compression springs 66 remain to be compressed. Thus, the movable contacts 64 are pushed against the stationary contacts 63, 67 under a predetermined pressure, so that any adverse effect may be caused on the contact-making condition even if the electric switch should be shocked.

Figure 13A:
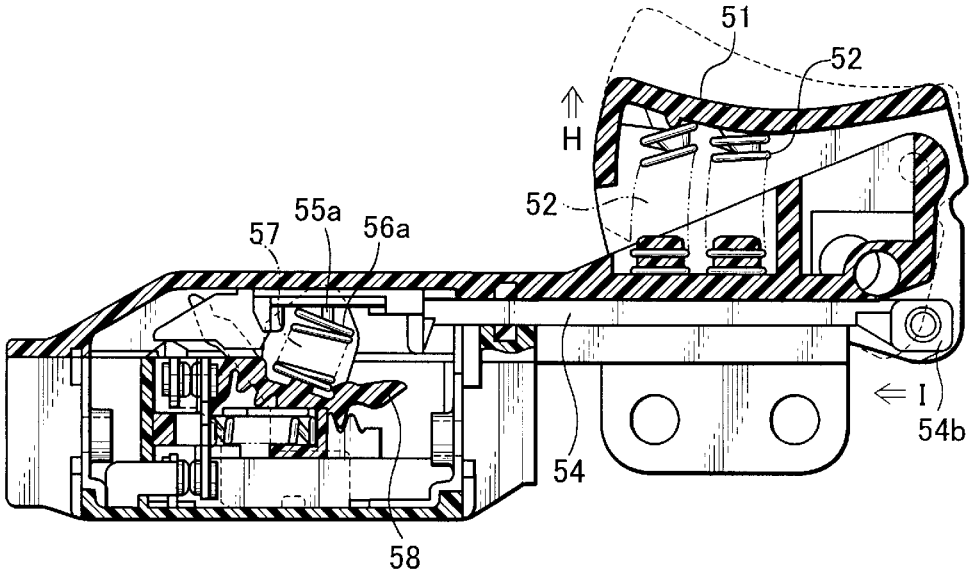
FIGS. 13*a* and 13*b* are longitudinal sections of the electric switch, showing how the electric switch works.
Figure 13B:
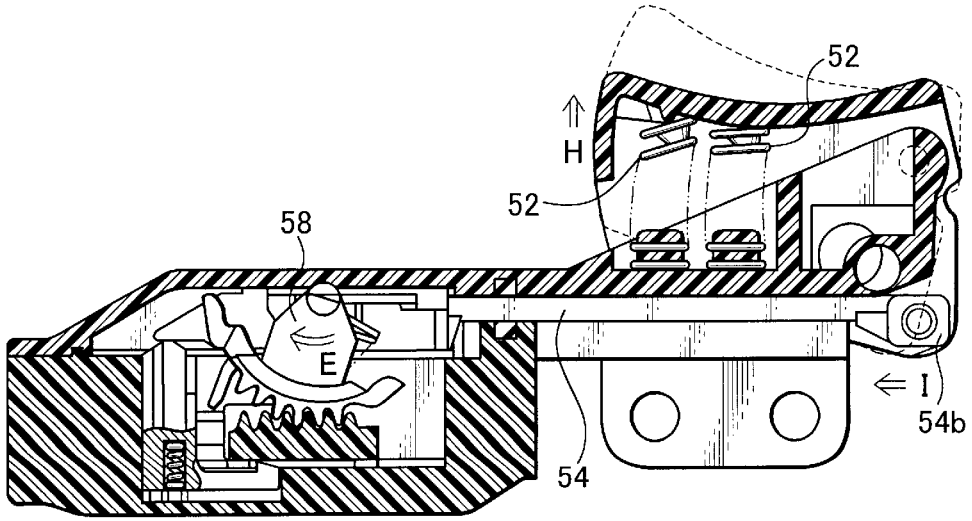

Referring to FIGS. 13*a* and 13*b*, the push given to the operating lever 51 is reduced more or less, the operating lever 51 is moved back by the return spring 52 in the direction as indicated by the arrow "H", and at the same time, the rear block 54*b* of the plunger 54 is pushed in the direction as indicated by the arrow I. Then, the projection 55*a* of the guide plate 55 pushes the upper disk 56*a* forward, starting compression of the reversal spring 57. In this position, however, the reversal member 58 remains as it is, while being kept energized in the direction as indicated by the arrow E.

Figure 14A:
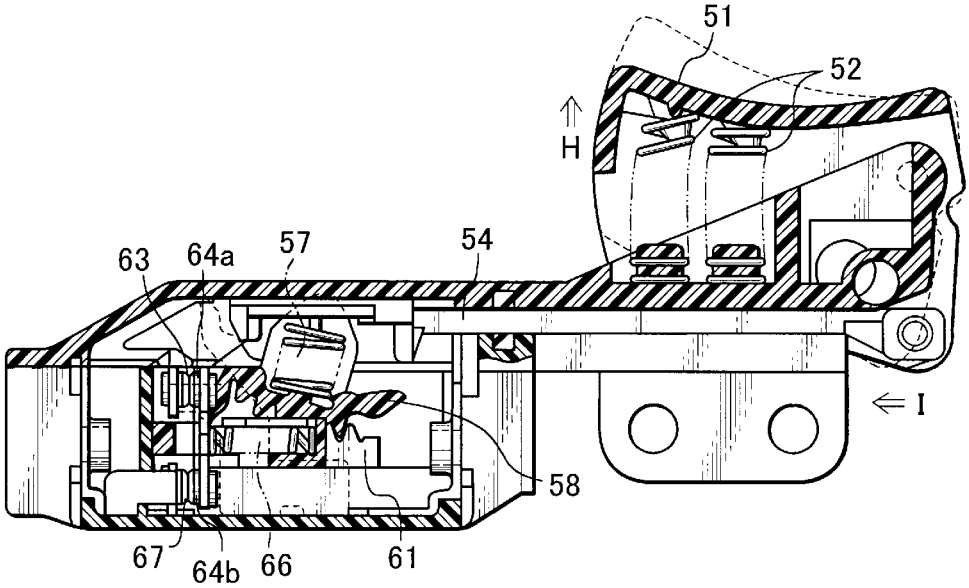
FIGS. 14*a* and 14*b* are longitudinal sections of the electric switch, showing how the electric switch works.
Figure 14B:
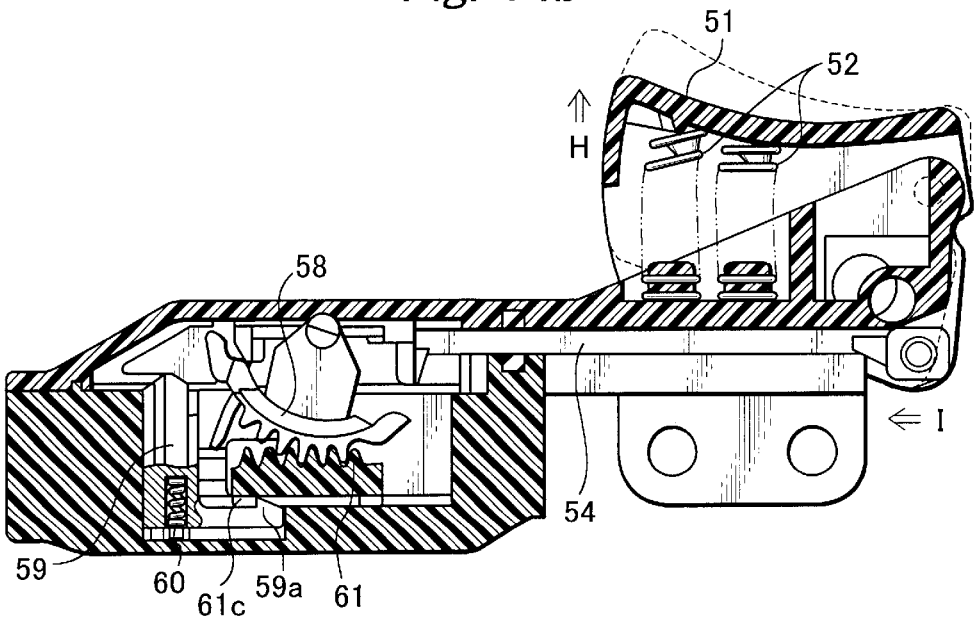

Referring to FIGS. 14*a* and 14*b*, the operating lever 51 is rotated further in the direction as indicated by the arrow H, moving the plunger 54 in the direction as indicated by the arrow I. As a result the reversal spring 57 comes close to the reversal point. Around the reversal point the reversal member 58 is about to be jerked by the reversal spring 57 and the cooperative compression springs 66 of the actuator 61, reducing the pressure appearing between the movable contacts 64 and the stationary contacts 63, 67.

The actuator 61 cannot be moved backward because the guide projection 61*c* of the actuator 61 is caught by the hook 59*a* of the stopper 59. Thus, the movable contacts 64 remain to be pushed against the stationary contacts 63, 67.

Figure 15A:
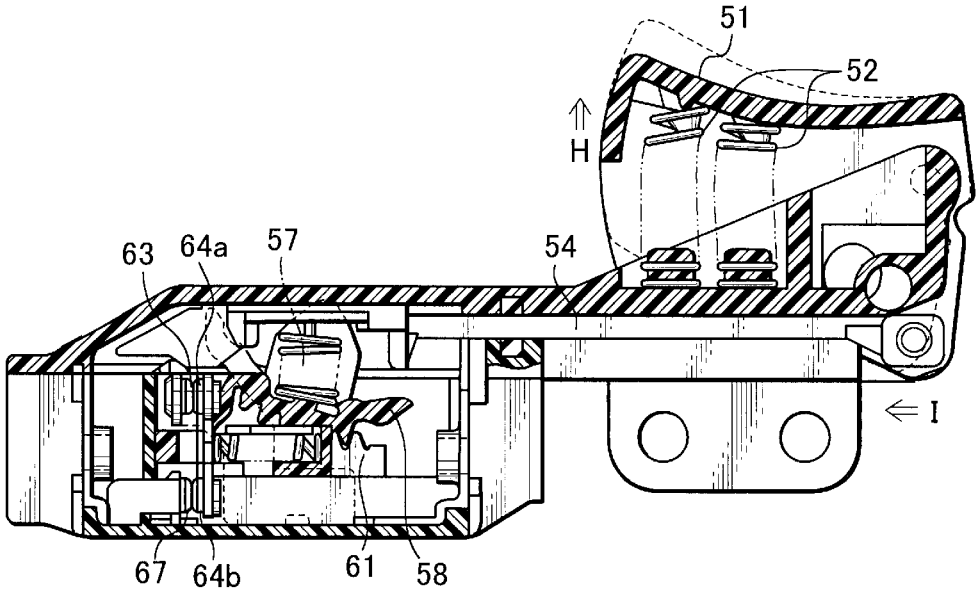
FIGS. 15*a* and 15*b* are longitudinal sections of the electric switch, showing how the electric switch works.
Figure 15B:
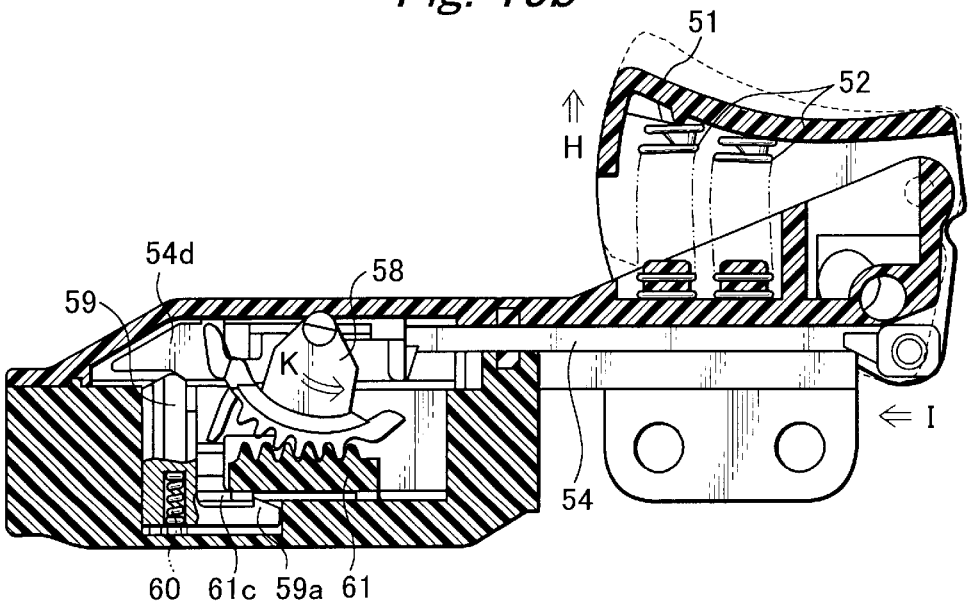

Referring to FIGS. 15*a* and 15*b*, further rotation of the operating lever 51 in the direction as indicated by the arrow H brings the reversal spring 57 close to the reversal point for rotating the reversal member 58 in the direction as indicated by the arrow K. As is the case with the position of FIGS. 14*a* and 14*b*, the guide projection 61*c* of the actuator 61 is caught by the hook 59*a* of the stopper 59, thereby preventing the actuator 61 from moving backward. Thus, the electric switch is kept turning on.

As the plunger 54 moves in the direction as indicated by the arrow 1, the hook 59*a* of the horizontal leg of the L-shaped stopper 59 lowers gradually while the vertical leg 59 of the L-shaped stopper 59 following the lower surface contour of the front 54*d* of the plunger 54 overcomes the stopper spring 60.

Figure 16A:
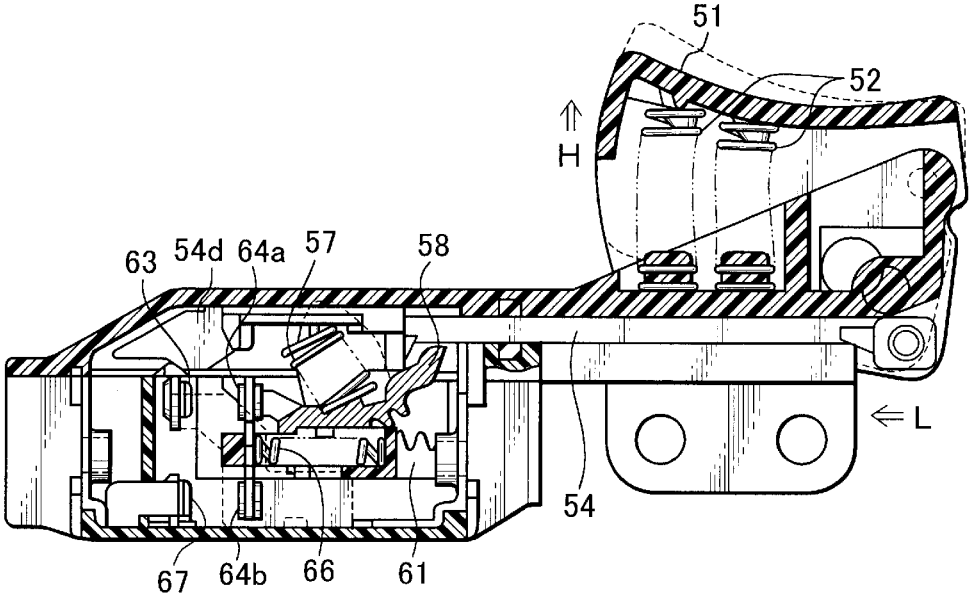
FIGS. 16*a* and 16*b* are longitudinal sections of the electric switch, showing how the electric switch works.
Figure 16B:
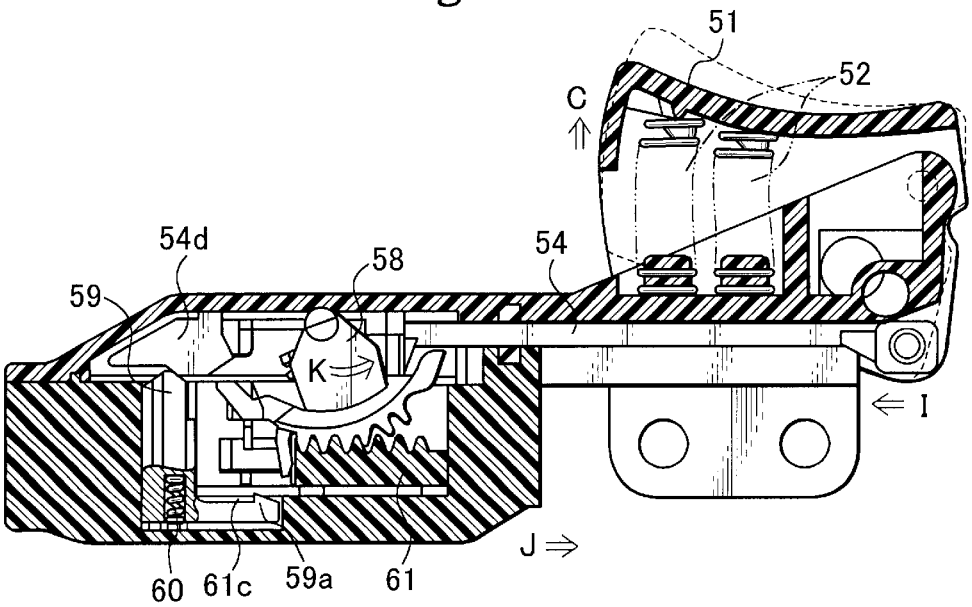

Referring to FIGS. 16*a* and 16*b*, still further rotation of the operating lever 51 in the direction as indicated by the arrow H moves the plunger 54 in the direction as indicated by the arrow I. The hook 59*a* of the stopper member 59 is lowered to release the guide projection 61*c* of the actuator 61 from the hook for unlatching.

The reversal spring 57 traverses the reversal point to release the stored energy, thereby making the reversal member rotate instantly in the direction as indicated by the arrow K. Then, the actuator 61 is jerked in the direction as indicated by the arrow J via the pinion-and-rack mechanism, and the movable contacts 64 leave the stationary contacts 63, 67 quickly. The electric switch turns off, returning to the initial position as shown in FIGS. 7*a* and 7*b*.

The electric switch is equipped with a forced contact-separation mechanism, by which the movable contacts 64 can be pulled off from the stationary contacts even if the movable contacts 64 are lightly melted and attached to the stationary contacts 63, 67.

Figure 17A:
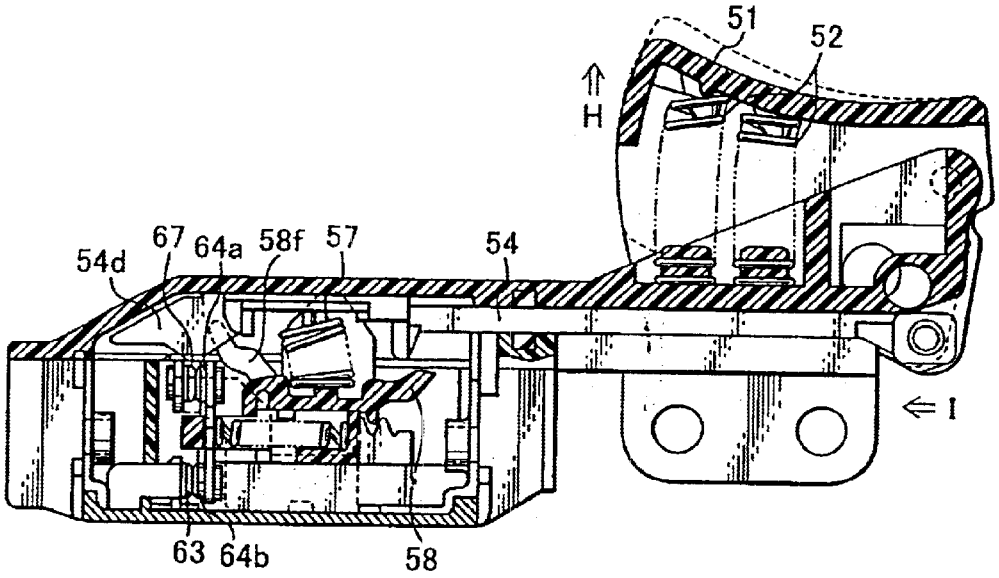
FIGS. 17*a* and 17*b* are longitudinal sections of the electric switch, showing how the electric switch works.
Figure 17B:
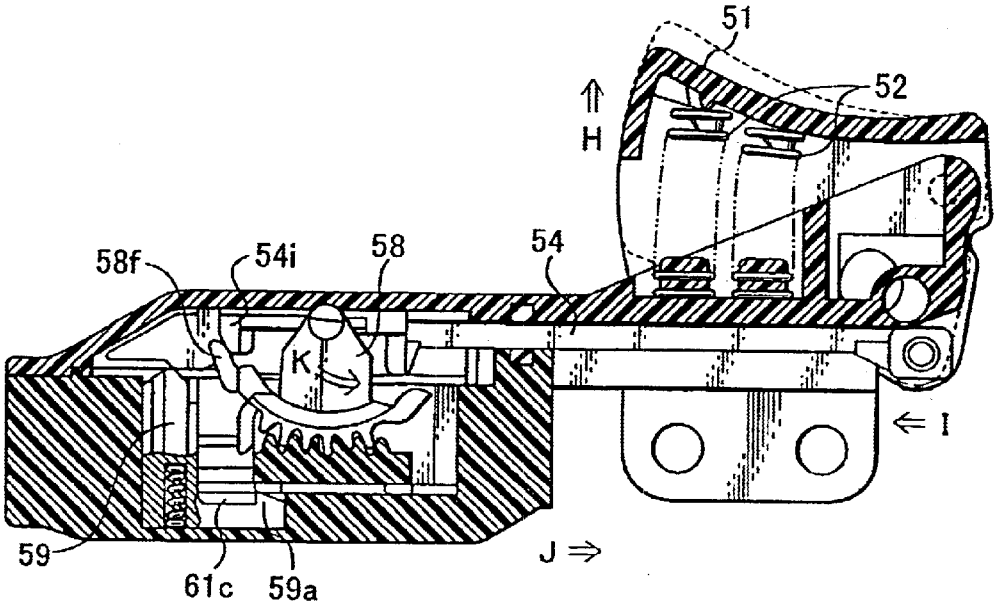
Figure 18:
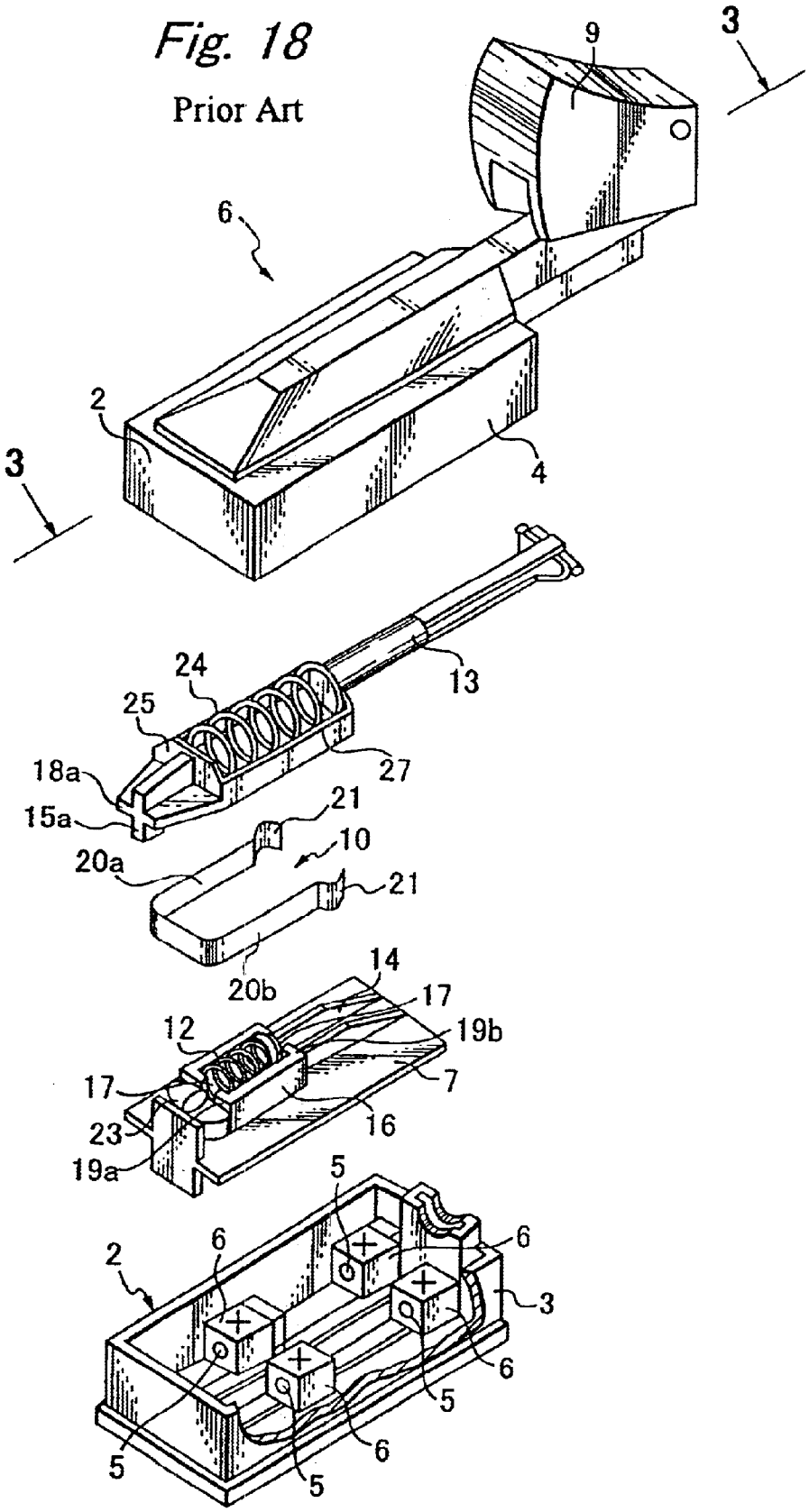
Fig. 18 Prior Art
FIG. 18 is an exploded view of a conventional electric switch.
Figure 19:
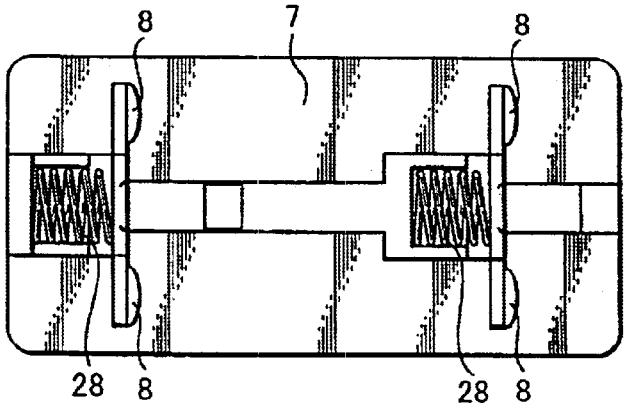
Fig. 19 Prior Art
FIG. 19 is a bottom view of a slide of the conventional electric switch.
Figure 20:
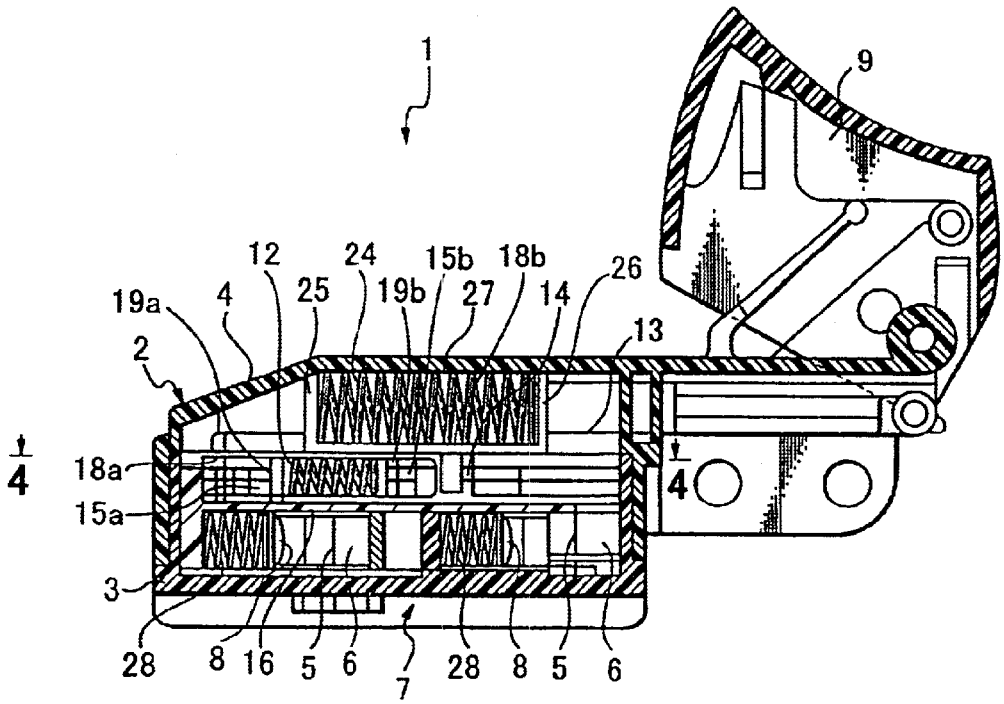
Fig. 20 Prior Art
FIG. 20 is a longitudinal section of the conventional electric switch.
Figure 21:
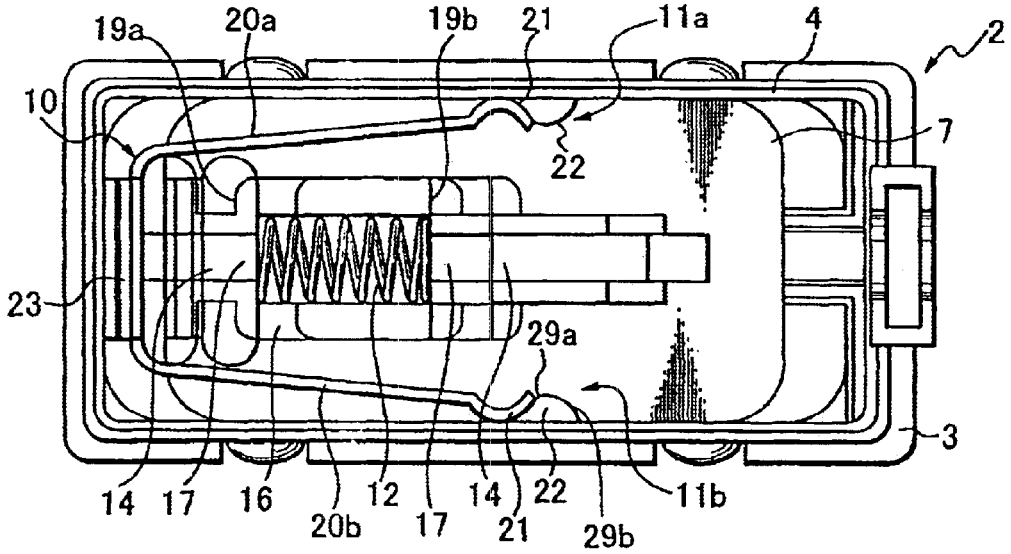
Fig. 21 Prior Art
FIG. 21 is a plan view of a main part of the conventional electric switch, removing the uppermost layer of a three-layer structure.
Figure 22:
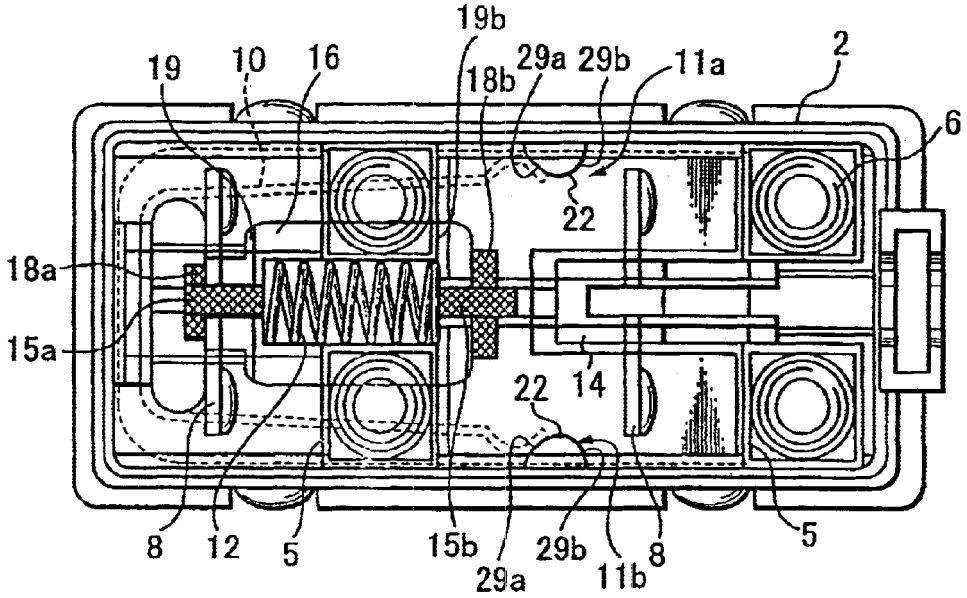
Fig. 22 Prior Art
FIG. 22 is a plan view of the main part of the conventional electric switch, showing the intermediate layer of the three-layer structure.
Figure 23:
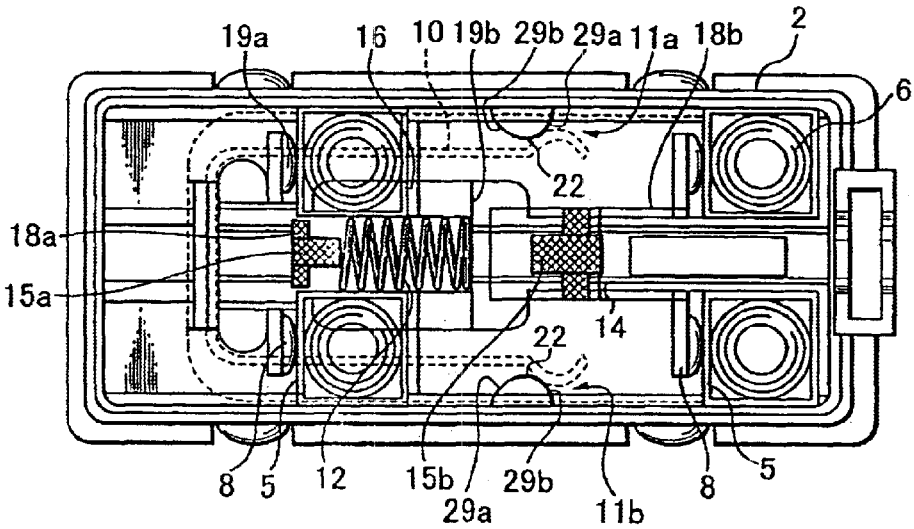
Fig. 23 Prior Art
FIG. 23 is a plan view similar to FIG. 22 but with the switch in a different condition.
Figure 24:
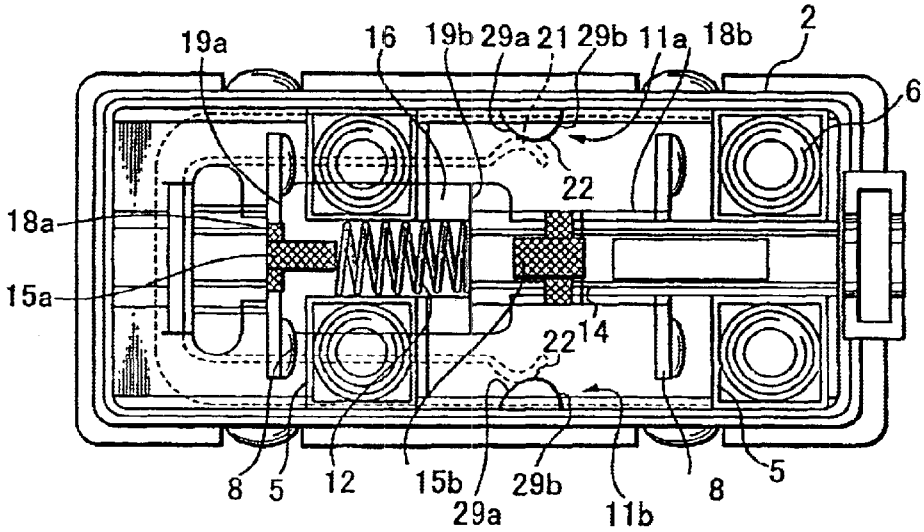
Fig. 24 Prior Art
FIG. 24 is another plan view similar to FIG. 22 but with the switch in another different condition.
Figure 25:
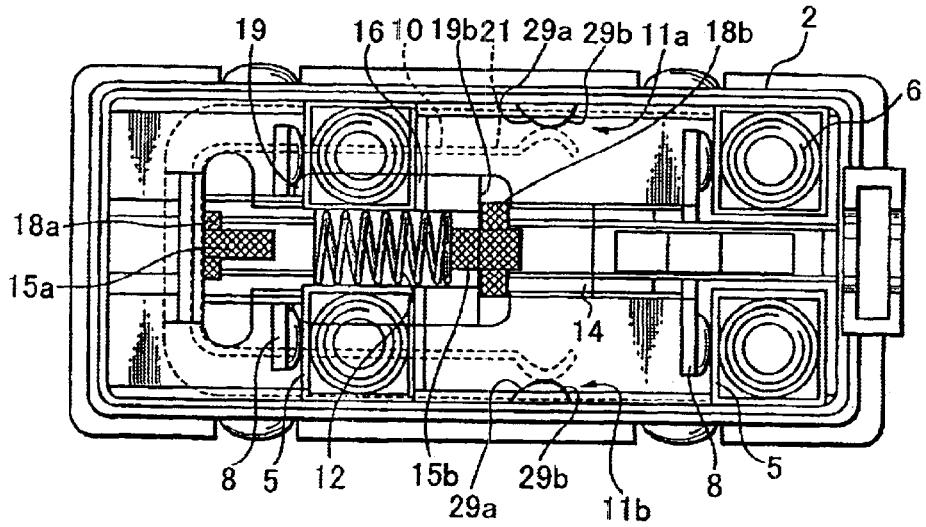
Fig. 25 Prior Art
FIG. 25 is still another plan view similar to FIG. 22 but with the switch in yet another condition.

Referring to FIGS. 17*a* and 17*b*, even if the movable contacts 64 are lightly melted and attached to the stationary contacts 63, 67, the operating lever 51 is rotated in the direction as indicated by the arrow H to move the plunger 54 in the direction as indicated by the arrow I. The lower surface contour of the front 54*d* of the plunger 54 makes the stopper 59 descend to release the guide projection 61*c* of the actuator 61 from the hook 59*a*, but the electric switch is kept turning on in spite of the reversal point having been traversed.

The plunger 54 is pushed still further by the return spring 52 in the direction as indicated by the arrow I. As a result, the projection 54*i* of the plunger 54 abuts on the projection 58*f* of the reversal member 58 to rotate the reversal member 58 in the direction as indicated by the arrow K. Then, the actuator 61 is moved by the reversal member 58 in the direction as indicated by the arrow J, forcedly separating the movable contacts 64 from the stationary contacts 63, 67.

As may be understood from the above, the switching mechanism according to the present invention uses the reversal spring for quickly turning on and off in such a way that the movable contacts may be brought close to the stationary contacts prior to the turning-on, thereby permitting the quick turning-on subsequent to traverse of the reversal point without the bouncing of the movable contacts off from the stationary contacts, and that movement of the movable contacts may be prevented before the reversal spring has stored an increased amount of energy, allowing the quick release of the stored energy to make the movable contacts leave the stationary contacts at a speed high enough to prevent appearance of electric arcs between the movable and stationary contacts, and hence the wearing of the contacts.

A coiled spring rather than a spring plate is used as the reversal spring because reversal springs of the same quality are commercially available, thus facilitating reproduction of spring-reversal type of electric switches of the same quality. An AC/DC electric switch suitable for use in electric power tools according to the present invention is guaranteed to be free of bouncing and wearing, and it can have a long-life and is of a high rating.

What is claimed is:

1. A switching mechanism in a spring-reversal type of electric switch comprising:

a casing having stationary contacts mounted therein; an actuator having movable contacts to mate with the stationary contacts and springs to push the rear sides of the movable contacts; an operating lever rotatable about its pivot for switching operation; a plunger operatively connected to the operating lever; a rotatable reversal member for driving the actuator; a reversal coiled spring one end of which is connected to the reversal member and the other end of which is connected to the plunger, the reversal coiled spring being responsive to transition across its reversal point for reversing its resilient force in direction, thus making the movable contacts move toward the stationary contacts or leave apart therefrom when depressing or releasing the operating lever, wherein the switching mechanism is so constructed that the actuator is allowed to move a predetermined distance before reaching the reversal point on the way to the switching "on" position, thus reducing the distance to the switching "on" position to travel the remaining distance instantly when the reversal member reverses, thereby making the movable contacts mate with the stationary contacts quickly; and the switching mechanism is so constructed that the actuator is prevented from moving before the reversal point is reached, and that the actuator is released after the reversal point is reached, thereby making the movable contacts leave the stationary contacts quickly.

2. A switching mechanism according to claim 1, wherein the rotatable reversal member has a pinion equipped therewith whereas the actuator has a rack equipped therewith.

3. A switching mechanism according to claim 1, wherein the plunger has a projection formed thereon; the rotatable reversal member has a projection formed thereon; these projections are so arranged that the projection of the plunger is responsive to depression of the operating lever for pushing the projection of the rotatable reversal member, thereby making the reversal member rotate thus to move the actuator, and hence the movable contacts close to the stationary contacts while stressing the reversal coiled spring.

4. A switching mechanism according to claim 1, wherein the forward end of the plunger has a difference in level via a gentle slope formed on its lower surface; a stopper having a hook formed thereon is biased upward by a stopper spring to keep the stopper abutting on the lower surface of the plunger; and the actuator has a projection to be caught by the hook of the stopper, whereby the actuator is locked by allowing the projection of the actuator to be caught by the hook of the stopper, and whereby while the stopper follows and climbs the lower surface of the forward end of the plunger the actuator is being unlocked by releasing the projection of the actuator from the hook of the stopper.

5. A switching mechanism according to claim 4, wherein on the way to the "on" position the stopper is raised, and the projection of the actuator climbs the hook of the raised stopper to be caught thereby, when the movable contacts abut on the stationary contacts, together put in locking condition.

6. A switching mechanism according to claim 4, wherein the operating lever is moved toward the switching "off" position to move the plunger, the gentle slope of the forward end of which still holds the hook of the stopper and the projection of the actuator in the locking condition for a while after the reversal point of the reversal spring is traversed, and upon further movement of the operating lever toward the switching "off" position the stopper follows the gentle slope of the forward end of the plunger to be lowered for unlocking and jerking the actuator, thus making the movable contacts leave the stationary contacts quickly.

7. An electric switch characterized in that it comprises:

an operating lever rotatable about its pivot;

a plunger operatively connected to the operating lever to move linearly in response to rotation of the operating lever;

a reversal member operatively connected to the plunger;

a pinion fixed to the lower surface of the reversal member;

a spring combined with the reversal member, responsive to the linear movement of the plunger for storing its resilient force until a predetermined strength of resilient force has been reached, and for releasing the stored strength of resilient force to rotate the pinion of the reversal member;

an actuator having movable contacts and having a rack to meet with the pinion for moving linearly in unison with rotation of the pinion; and a casing having stationary contacts on its opposite sides, whereby the movable contacts and stationary contacts are made to meet with each other in unison with reversal action of the reversal spring.

* * * * *